US007907158B2

(12) United States Patent
Koyama et al.

(10) Patent No.: US 7,907,158 B2
(45) Date of Patent: Mar. 15, 2011

(54) THERMAL HEAD AND PRINTING DEVICE

(75) Inventors: Noboru Koyama, Tokyo (JP); Izumi Kariya, Kanagawa (JP); Mitsuo Yanase, Kanagawa (JP); Toru Morikawa, Kanagawa (JP)

(73) Assignee: Sony Corporation, Tokyo (JP)

( * ) Notice: Subject to any disclaimer, the term of this patent is extended or adjusted under 35 U.S.C. 154(b) by 905 days.

(21) Appl. No.: 11/716,711

(22) Filed: Mar. 12, 2007

(65) Prior Publication Data

US 2007/0257980 A1 Nov. 8, 2007

(30) Foreign Application Priority Data

Mar. 17, 2006 (JP) ..... 2006-075661

(51) Int. Cl.
*B41J 2/34* (2006.01)
*B41J 2/335* (2006.01)

(52) U.S. Cl. ..... 347/208; 347/62; 347/204; 347/209

(58) Field of Classification Search ..... 347/56, 347/61, 62, 200, 201, 204–209
See application file for complete search history.

(56) References Cited

U.S. PATENT DOCUMENTS

| | | | | |
|---|---|---|---|---|
| 4,742,362 | A * | 5/1988 | Takoshima et al. | 347/202 |
| 5,949,465 | A | 9/1999 | Taniguchi et al. | |
| 5,978,007 | A * | 11/1999 | Sawano et al. | 347/202 |
| 6,339,444 | B1 * | 1/2002 | Sugiyama | 347/200 |

FOREIGN PATENT DOCUMENTS

| | | | |
|---|---|---|---|
| DE | 34 35 407 | A1 | 4/1986 |
| EP | 1 403 075 | A1 | 3/2004 |
| JP | 61-254362 | | 11/1986 |
| JP | 63-115765 | | 5/1988 |
| JP | 63-202465 | A | 8/1988 |
| JP | 08-216443 | | 8/1996 |
| JP | 09-174905 | A | 7/1997 |
| JP | 2006-035836 | A | 2/2006 |

OTHER PUBLICATIONS

European Search Report; Application No./Patent No. 07104270.9-2304 / 1834791; Dated: Sep. 5, 2008.

* cited by examiner

*Primary Examiner* — Daniel Petkovsek

(74) *Attorney, Agent, or Firm* — Radar, Fishman & Grauer PLLC

(57) ABSTRACT

A thermal head includes a glass layer having a protruding section formed on one surface and a concave groove section formed on the other surface facing the protruding section, a heat generation resistor provided on the protruding section, and a pair of electrodes provided to both sides of the heat generation resistor, and a part of the heat generation resistor exposed between the pair of electrodes is defined as a heat generation section, the protruding section has a smaller curvature radius in both sides than a curvature radius in a central portion, and a width of the groove section is one of equal to and larger than a length of the heat generation section.

12 Claims, 19 Drawing Sheets

THERMAL HEAD AND PRINTING DEVICE

CROSS REFERENCES TO RELATED APPLICATIONS

The present invention contains subject matter related to Japanese Patent Application JP 2006-075661 filed in the Japan Patent Office on Mar. 17, 2006, the entire contents of which being incorporated herein by reference.

BACKGROUND OF THE INVENTION

1. Technical Field

The present invention relates to a thermal head and a printing device for thermal-transferring a color material on an ink ribbon to a print medium.

2. Related Art

As a printing device for printing images or characters on a print medium, there is a thermal transfer printing device (hereinafter simply referred to as a printing device) which sublimates a color material forming a ink layer provided to one surface of an ink ribbon to thermal-transfer the color material to a print medium, thereby printing color images or characters. The printing device is provided with a thermal head for thermal-transferring the color material on the ink ribbon to the print medium and a platen disposed at a position facing the thermal head and for supporting the ink ribbon and the print medium.

In the printing device, the ink ribbon and the print medium are overlapped so that the ink ribbon faces the thermal head and the print medium faces the platen, and the ink ribbon and the print medium run between the thermal head and the platen while the platen presses the ink ribbon and the print medium against the thermal head. In this case, the printing device applies thermal energy to the ink ribbon running between the thermal head and the platen with the thermal head on the ink layer from the rear face side of the ink ribbon, and sublimates the color material with the thermal energy to thermal-transfer the color material to the print medium, thereby printing color images or characters.

In this thermal transfer printing device, power consumption becomes larger when printing at higher speed because the thermal head needs to be rapidly heated to a high temperature. Therefore, it is difficult particularly in home-use-printing devices to increase printing speeds while achieving lower power consumption. In order for achieving high speed printing particularly by a home-use thermal transfer printing device, it is required to improve the thermal efficiency of the thermal head to reduce power consumption.

As a thermal head for a thermal transfer printing device used from the past, for example, a thermal head 100 shown in FIG. 20 can be cited. The thermal head 100 is composed of a glass layer 102 formed on a ceramic substrate 101, and a heat generating resistor 103, a pair of electrodes 104*a*, 104*b* for making the heat generating resistor generate heat, a protective layer 105 for protecting the heat generating resistor 103 and the electrodes 104*a*, 104*b* sequentially formed on the glass layer 102. In the thermal head 100, a part of the heat generating resistor 103 exposed from a gap between the pair of electrodes 104*a*, 104*b* forms a heat generating section 103*a* for generating heat. The glass layer 102 is formed to have a substantially circular arc shape in order for making the heat generating section 103*a* face the ink ribbon and the print medium.

Since the ceramic substrate 101 having high thermal conductivity is used in the thermal head 100, the thermal energy generated from the heat generating section 103*a* is radiated from the glass layer 102 through the ceramic substrate 101 to rapidly lower the temperature, thus offering a preferable response. However, in the thermal head 100, since the thermal energy in the heat generation section 103*a* is radiated to the side of the ceramic substrate 101 to easily reduce the temperature, the power consumption in raising the temperature to the sublimation point increases, thus making the thermal efficiency worse. According to the thermal head 100, although the preferable response can be obtained, thermal efficiency is degraded, and accordingly, it is required to heat the heat generating section 103*a* for a long period of time to obtain a desired depth, which causes large power consumption and makes it difficult to improve the printing speed while achieving low power consumption.

In order for solving such a problem, the inventors of the present invention invented a thermal head 110 as shown in FIG. 21. This thermal head will be explained below as related art of the present invention, in which the thermal head 110 uses a glass layer 111 having lower thermal conductivity than the ceramic substrate instead of the ceramic substrate in order for preventing the thermal energy in thermal-transferring the color material to the print medium from being conducted to the substrate side. The thermal head 110 is composed of a heat generating resistor 112, a pair of electrodes 113*a*, 113*b* and protective layer 114 sequentially formed on the glass layer 111 provided with a protruding section 111*a* having a substantially circular arc shape. The protruding section 111*a* of the glass layer 111 is formed like a substantially circular arc in order for making a heat generating section 112*a* of the heat generating resistor 112, which is exposed from a gap between the pair of electrodes 113*a*, 113*b*, and generating heat, face the ink ribbon and the print medium.

In the thermal head 110, since the glass layer 111 having lower thermal conductivity than the ceramic substrate 101 shown in FIG. 20 serves as the ceramic substrate 101, it becomes difficult for the thermal energy generated from the heat generating section 112*a* to be radiated to the side of the glass layer 111. Thus, in the thermal head 110, the quantity of the heat conducted to the ink ribbon side can be increased, thus the temperature thereof can rapidly be raised in thermal-transferring the color material to the print medium. Therefore, it becomes possible to reduce power consumption for raising the temperature to the sublimation temperature, thus making the thermal efficiency more preferable. However, in the thermal head 110, it becomes difficult for the thermal energy stored in the glass layer 111 to be radiated, thus the temperature of the thermal head 110 does not drop immediately because of the thermal energy stored in the glass layer 111, which degrades the response in contrast to the case with the thermal head 100. Thus, in the thermal head 110, since the response is degraded even with the improved thermal efficiency, it is difficult to increase the printing speed.

Since it is required to improve both of the thermal efficiency, which is a downside of the thermal head 100, and the response, which is a downside of the thermal head 110, for achieving high speed printing of high quality images or characters with reduced power consumption in thermal transfer printing devices, the inventors of the present invention further invented a thermal head 120 as shown in FIG. 22. This thermal head will be explained below as further related art of the present invention, in which the thermal head 120 is composed of a heat generating resistor 122, a pair of electrodes 123*a*, 123*b*, a protective layer 124 sequentially formed on the glass layer 121 having a protruding section 121*a* formed like a substantially circular arc in order for making a heat generating section 122*a* of the heat generating resistor 122, which is exposed from a gap between the pair of electrodes 123*a*,

123*b*, face the ink ribbon and the print medium, and inside the glass layer 121, there is formed a groove section 125 filled with air.

In the thermal head 120, by providing a groove section 125 to the glass section 121, the thermal conductivity of the groove section 125 is lowered because of the nature of air of having lower thermal conductivity than glass, thus the heat radiation to the glass layer 121 side can further suppressed than in the case with the thermal head 100 shown in FIG. 20 using the ceramic substrate 101. Thus, in the thermal head 120, the amount of heat conducted to the ink ribbon side increases, and accordingly, the power consumption for raising the temperature to the sublimation temperature of the color material can be reduced when thermal-transferring the color material, thus making the thermal efficiency preferable. Further, in the thermal head 120, since the thickness of the glass layer 121 is made thinner to reduce the heat storage capacity of the glass layer 121 by providing the groove section 125 to the glass layer 121, the thermal energy stored in the glass layer 121 can be radiated in a shorter period of time than in the case with the thermal head 110 shown in FIG. 21 without the groove in the glass layer 111, thus rapidly lowering the temperature when the color material is not thermal-transferred to make the response preferable. According to these facts, in the thermal head 120, both of the thermal efficiency and the response can be made preferable by providing the groove section 125 to the glass layer 121. In other words, the downsides of the thermal head 100 and the thermal head 110 described above can be solved at the same time in the thermal head 120.

However, even in such a thermal head 120, it is required to further improve the thermal efficiency in order for performing high speed printing with further reduced power consumption. Further, in the thermal head 120, the physical strength of the glass layer 121 might be lowered by providing the groove section 125 to the glass layer 121.

The related art is described in JP-A-8-216443.

SUMMARY

It is therefore desirable to provide a thermal head and a printing device preferable in the thermal efficiency and the response.

According to an embodiment of the present invention, there is provided a thermal head including a glass layer having a protruding section formed on one surface and a concave groove section formed on the other surface facing the protruding section, a heat generation resistor provided on the protruding section, and a pair of electrodes provided to both sides of the heat generation resistor, wherein a part of the heat generation resistor exposed between the pair of electrodes is defined as a heat generation section, the protruding section has a smaller curvature radius in both sides than a curvature radius in a central portion, and a width of the groove section is one of equal to and larger than a length of the heat generation section.

According to an embodiment of the present invention, there is provided a printing device including a thermal head having a glass layer having a protruding section formed on one surface and a concave groove section formed on the other surface facing the protruding section, a heat generation resistor provided on the protruding section, and a pair of electrodes provided to both sides of the heat generation resistor, wherein a part of the heat generation resistor exposed between the pair of electrodes of the thermal head is defined as a heat generation section, the protruding section of the glass layer has a smaller curvature radius in both sides than a curvature radius in a central portion, and a width of the groove section is one of equal to and larger than a length of the heat generation section.

In embodiment of the invention, by forming the groove section in the glass layer, it becomes difficult for the heat generated by the heat generation section to radiated to the glass layer side, thus the thermal efficiency can be improved. Further, in the embodiment of the invention, the heat storage capacity of the glass layer is reduced by providing the groove section, thus the heat can easily be radiated and the response is improved. From the facts described above, thermal efficiency and response can be improved in the invention. Further, according to the embodiment of the invention, by forming the groove section to have a width equal to or larger than the length of the heat generation section, the thickness of the both ends of the heat storage section facing the heat generation section and storing the heat is made smaller, thus the heat radiation from the both ends can be suppressed to further improve the thermal efficiency. Further, in the embodiment of the invention, the thickness of the both ends of the heat storage section is made further smaller by making the curvature radius of the both sides of the protruding section smaller than the curvature radius in the central portion thereof, thus the thermal efficiency can further be improved. Thus, in the embodiments of the invention, high speed printing with low power consumption can be achieved.

BRIEF DESCRIPTION OF THE DRAWINGS

FIGS. 5A and 5B are cross-sectional views of the head section, wherein FIG. 5A is a cross-sectional view of the whole of the head section, and FIG. 5B is a partial cross-sectional view enlargedly showing a leading end side of the groove section.

FIGS. 8A and 8B are cross-sectional views of another example of the head section, wherein FIG. 8A is a cross-sectional view of the whole of the head section, and FIG. 8B is a partial cross-sectional view enlargedly showing a protruding section.

DESCRIPTION OF THE EMBODIMENTS

Hereinafter, a thermal transfer printing device implementing a thermal head applying an embodiment of the invention will be explained in detail with reference to the accompanying drawings.

Figure 1:
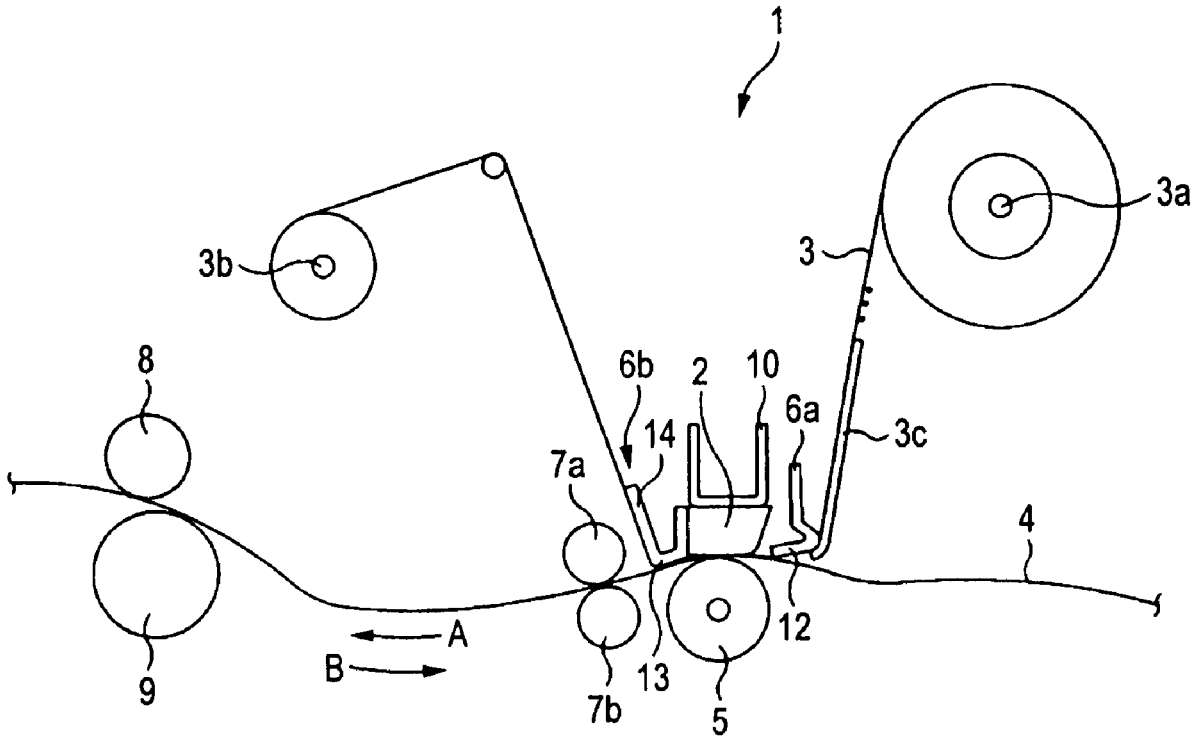
FIG. 1 is a schematic diagram of a printing device using a thermal head applying an embodiment of the invention.

A thermal transfer printing device 1 (hereinafter referred to as a printing device 1) shown in FIG. 1 is a dye sublimation printer for sublimating a color material of an ink ribbon to thermal-transfer the color material to a print medium, and uses a thermal head 2 applying an embodiment of the invention as a recording head. The printing device 1 applies thermal energy generated by the thermal head 2 to the ink ribbon 3, thereby sublimating the color material of the ink ribbon 3 to thermal-transfer it to the print medium 4, thus printing color images or characters. The printing device 1 is a home-use printing device, and is able to print on objects of, for example, a post card size as the print medium 4.

The ink ribbon 3 used here is formed of a long resin film, and is housed in an ink cartridge in a condition in which a part of the ink ribbon 3 not yet used in the thermal transfer process is wound around a supply spool 3*a* while a part of the ink ribbon 3 already used in the thermal transfer process is wound around a winding spool 3*b*. The ink ribbon 3 is provided with a transfer layer 3*c* repeatedly formed in a plane on one side of the long resin film, the transfer layer 3*c* being composed of an ink layer formed of a yellow color material, an ink layer formed of a magenta color material, an ink layer formed of a cyan color material, and a laminate layer formed of a laminate film to be thermal-transferred on the print medium 4 for improving stability of images or characters printed on the print medium 4.

Figure 2:
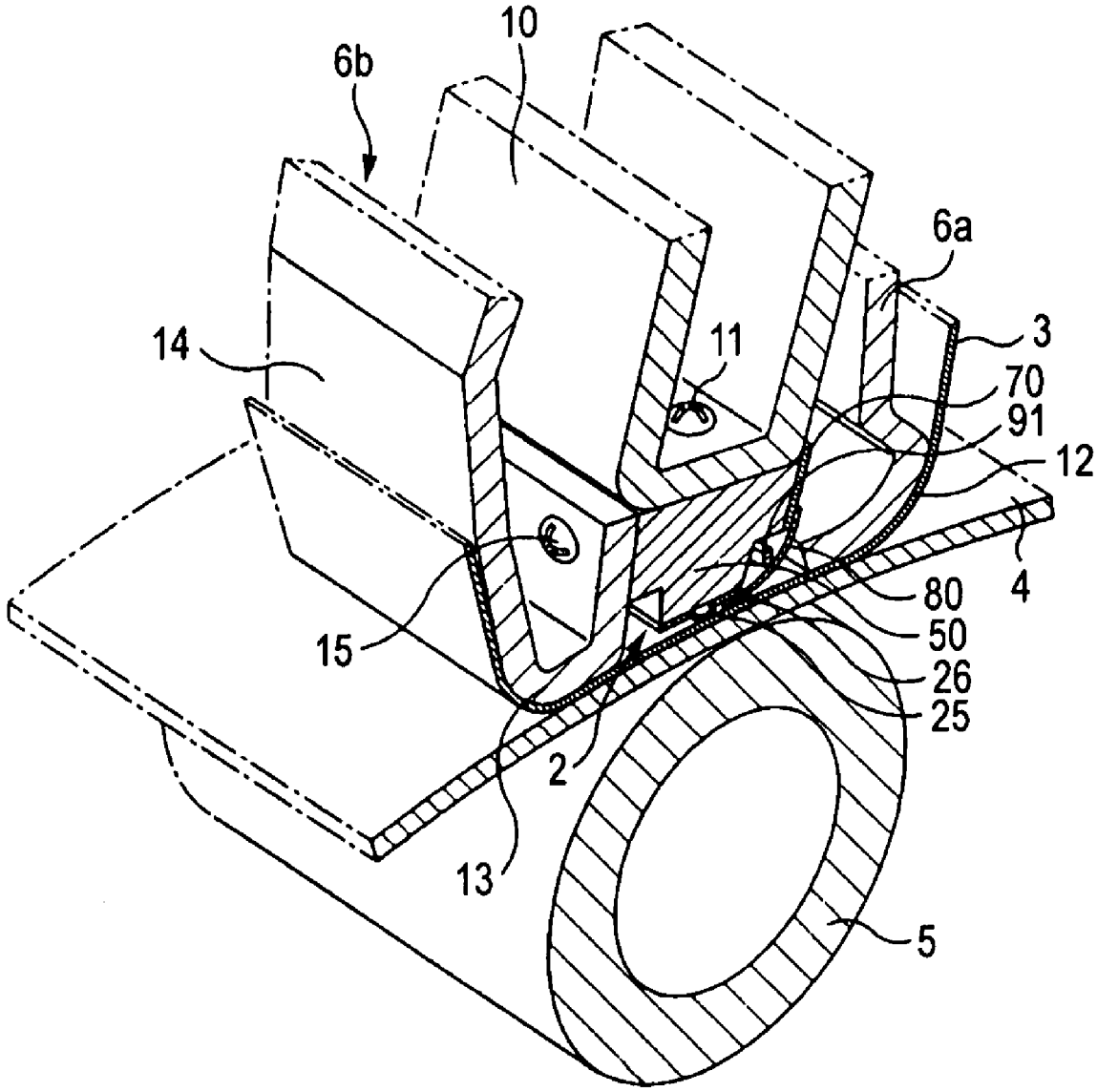
FIG. 2 is a partial perspective view showing a relationship between the thermal head and a ribbon guide.

As shown in FIG. 1, the printing device 1 is provided with a thermal head 2, a platen 5 disposed at a position facing the thermal head 2, a plurality of ribbon guides 6*a*, 6*b* for guiding running of the ink ribbon 3 mounted thereon, a pinch roller 7*a* and a capstan roller 7*b* for running the print medium 4 together with the ink ribbon 3 between the thermal head 2 and the platen 5, an ejection roller 8 for ejecting the print medium on which printing has been performed, and a feed roller 9 for carrying the print medium 4 towards the thermal head 2. As shown in FIG. 2, the thermal head 2 is provided to the printing device 1 by attaching to an attachment member 10 on the side of the housing of the printing device 1 with a fixing member 11 such as a screw.

The ribbon guides 6*a*, 6*b* for guiding the ink ribbon 3 are disposed in front of and behind the thermal head 2, namely, in the side from which the ink ribbon 3 enters and in the side to which the ink ribbon 3 is ejected with respect to the thermal head 2. The ribbon guides 6*a*, 6*b* guide the ink ribbon 3 and the print medium 4 between the thermal head 2 and the platen in front of and behind the thermal head 2 so that the ink ribbon 3 and the print medium 4 overlapping each other abut on the thermal head 2 substantially perpendicular to each other, thus the thermal energy of the thermal head 2 can surely be applied to the ink ribbon 3.

The ribbon guide 6*a* is disposed in the side from which the ink ribbon 3 enters with respect to the thermal head 2. The ribbon guide 6*a* has a curved surface in the lower end surface 12, and guides the ink ribbon 3 supplied from the supply spool 3*a* disposed upper position of the thermal head 2 to enter between the thermal head 2 and the platen 5.

The ribbon guide 6*b* is disposed in the side to which the ink ribbon 3 is ejected with respect to the thermal head 2. The ribbon guide 6*b* has a flat section 13 evenly formed on the lower end and a separation section 14 rising substantially perpendicular from the end of the flat section 13 opposite the thermal head 2 and for breaking away the ink ribbon 3 from the print medium 4. The ribbon guide 6*b* removes the heat of the ink ribbon 3 after the thermal transfer process by the flat section 13, and then raises the ink ribbon 3 substantially perpendicular to the print medium 4 by the separation section 14 to break away the ink ribbon 3 from the print medium 4. The ribbon guide 6*b* is attached to the thermal head 2 with a fixing member 15 such as a screw.

In the printing device 1 having such a configuration, as shown in FIG. 1, the winding spool 3*b* is rotated in a winding direction to run the ink ribbon 3 in the winding direction, and the print medium 4 is pinched between the pinch roller 7*a* and the capstan roller 7*b* and runs in an ejection direction by rotating the capstan roller 7*b* and the ejection roller 8 in the ejection direction (the direction of arrow A in FIG. 1) between the thermal head 2 and the platen 5 while pressing the platen 5 against the thermal head 2. In a printing operation, the thermal energy is fist applied to the yellow ink layer of the ink ribbon 3 from the thermal head 2 to thermal-transfer the yellow color material to the print medium 4 running while overlapping the ink ribbon 3. After thermal-transferring the yellow color material, in order for thermal-transferring the magenta color material to the image forming section on which images or characters are formed and the yellow color material has been thermal-transferred, the feed roller 9 is rotated towards the thermal head 2 (the direction of the arrow B in FIG. 1) to back-feed the print medium 4 to the thermal head 2, thus making the leading end of the image forming section face the thermal head 2 and the magenta ink layer of the ink ribbon 3 face the thermal head 2. Then, similarly to the case of thermal-transferring the yellow ink layer, the thermal energy is also applied to the magenta ink layer to thermal-transfer the magenta color material to the image forming section of the print medium 4. Regarding the cyan color material and the laminate film, they are also thermal-transferred to the image forming section similarly to the case of thermal-transferring the magenta color material, thus color images or characters are printed by sequentially thermal-transferring the cyan color material and the laminate film to the print medium 4.

The thermal head 2 used for such a printing device 1 can print a framed image having margins on both edges in a direction perpendicular to the running direction of the print medium 4, namely the width direction of the print medium 4, and also a frameless image without the margins. The thermal head 2 has a size in a direction designated by the direction of the arrow L shown in FIG. 3 larger than the width of the print medium 4 so that the color material can be thermal-transferred to the both edges of the print medium 4 in the width direction thereof.

Figure 3:
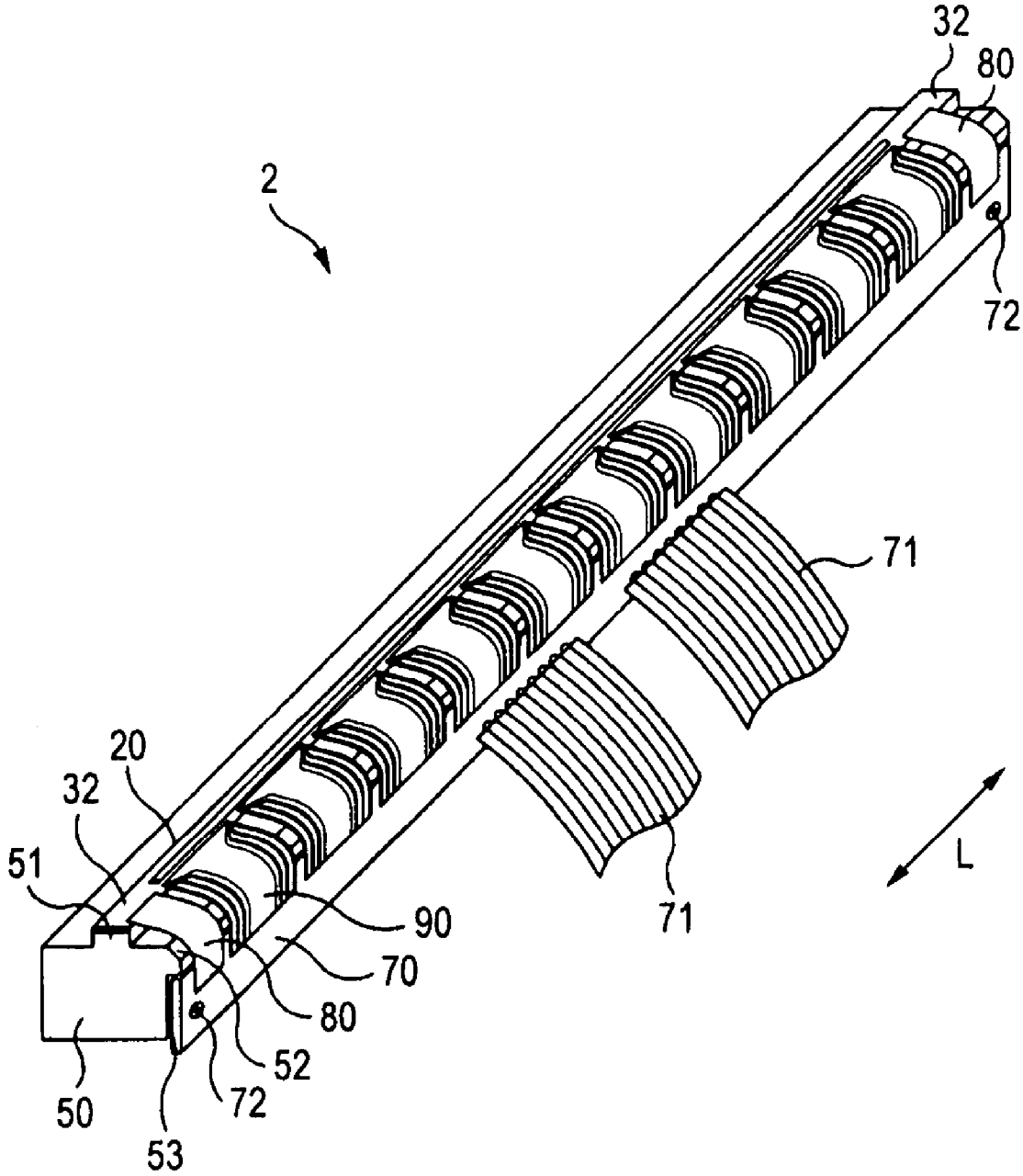
FIG. 3 is a perspective view of the thermal head.
Figure 4:
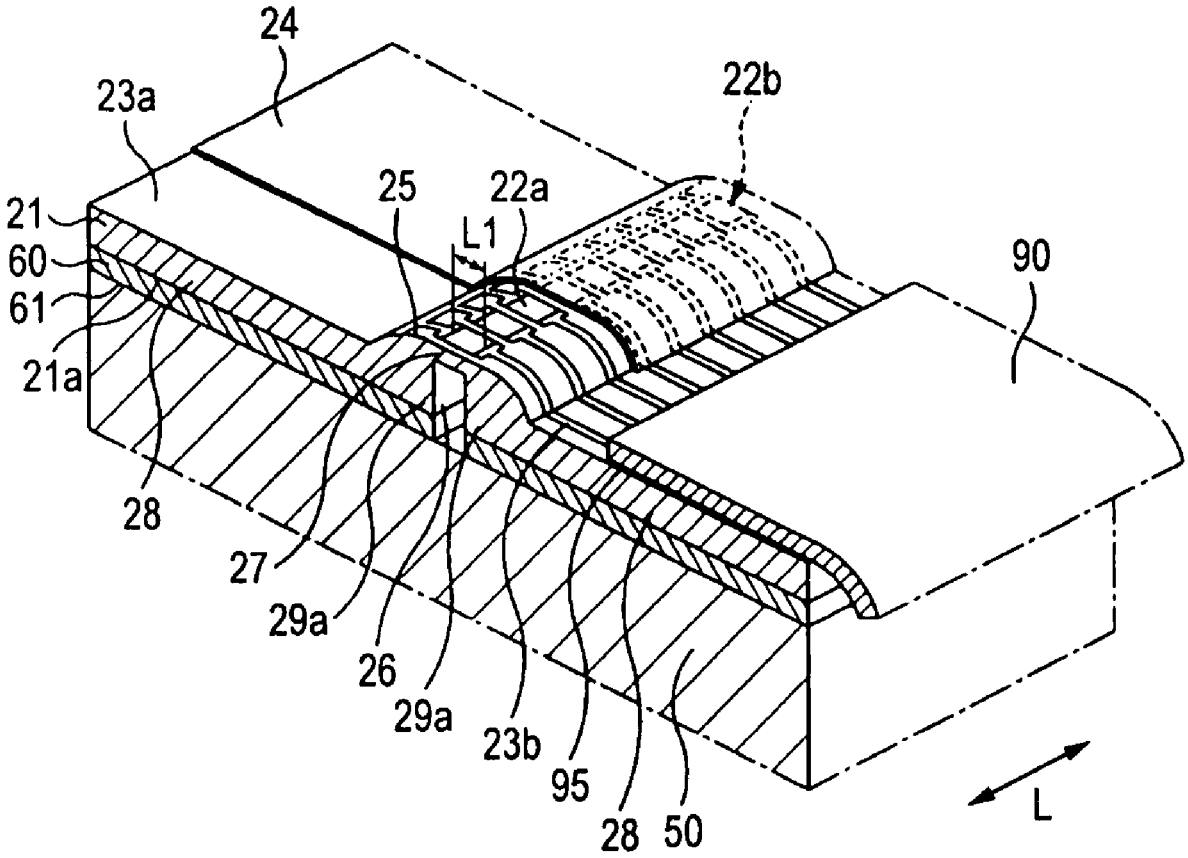
FIG. 4 is a partial perspective view of the thermal head.
Figure 5A:
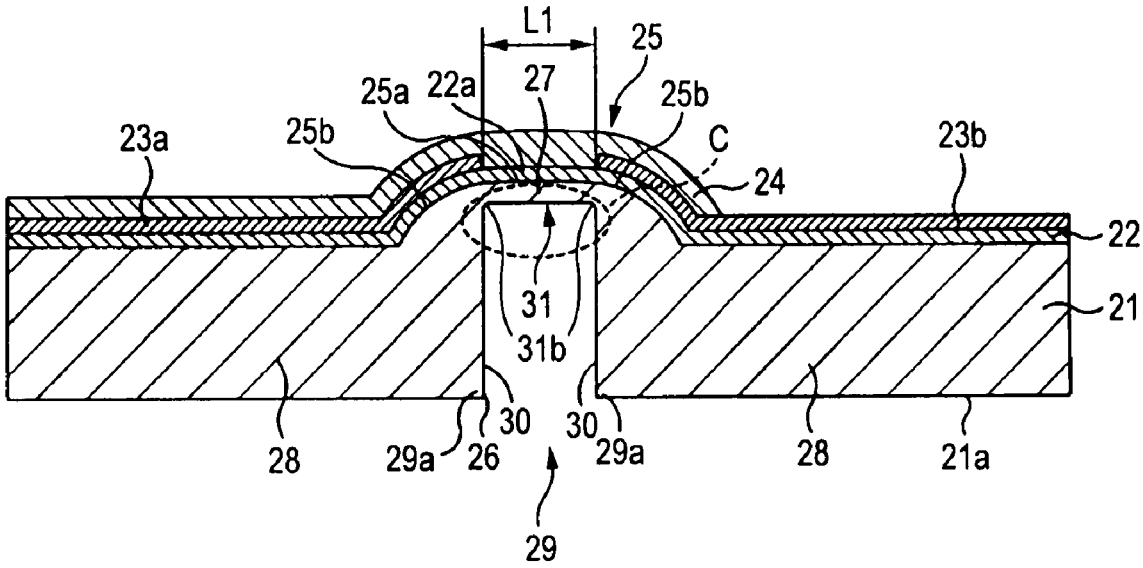

As shown in FIG. 3, the thermal head 2 is provided with a head section 20 for thermal-transferring the color material of the ink ribbon 3 to the print medium 4 attached to a heat radiation member 50. As shown in FIGS. 4 and 5A, the head section 20 is provided with a glass layer 21, a heat generation resistor 22 disposed on the glass layer 21, a pair of electrodes 23*a*, 23*b* disposed on both sides of the heat generation resistor 22, and a resistor protective layer 24 disposed on and around the periphery of the heat generation resistor 22. In the thermal head 2, a part of the heat generation resistor 22 exposed between the pair of electrodes 23*a*, 23*b* is defined as a heat generation section 22*a*. The glass layer 21 is provided with the pair of electrodes 23*a*, 23*b*, the heat generation resistor 22, and the resistor protective layer 24 formed on the upper surface thereof, and forms a base layer of the head section 20.

As shown in FIGS. 4 and 5A, the glass layer 21 has a substantially circular arc shaped protruding section 25 on the outer surface facing the ink ribbon 3, and a groove section 26 on the inner surface thereof. The glass layer 21 is made of glass having a softening point of, for example, 500° C. to form a substantially rectangular shape. The protruding section 25 is formed to have a substantially semicylindrical shape in a substantially central position of the glass layer 21 in the width direction along the length direction (the L direction in FIG. 2) thereof. The glass layer 21 improves the contact condition of the heat generation section 22*a* disposed on the protruding section 25 with the ink ribbon 3 by providing the protruding section 25 having a substantially circular arc shape on the surface facing the ink ribbon 3. Thus, it becomes possible that the thermal head 2 appropriately applies the heat generated by the heat generation section 22*a* of the heat generation resistor 22 to the ink ribbon 3.

It should be noted that the central section 25*a* of the protruding section 25 can be substantially flat. Further, it is sufficient that the glass layer 21 is made of a material having a predetermined surface property, a thermal characteristic, and so on represented by glass, and the concept of glass here includes synthetic gems or artificial stones such as synthetic quartz, synthetic ruby, or synthetic sapphire, or high-density ceramics.

As shown in FIGS. 4 and 5A, the groove section 26 provided to the inner surface of the glass layer 21 faces a line 22*b* of heat generation sections 22*a* disposed substantially linearly on the protruding section 25 in the length direction (the L direction in FIG. 4) of the thermal head 2, and is formed to have a concave shape towards the heat generation section 22*a*. Further, in the glass layer 21, a heat storage section 27 for storing the thermal energy generated by the heat generation section 22*a* is defined between the protruding section 25 and the groove section 26.

In the glass layer 21, by providing the groove section 26, according to the nature of air of having lower thermal conductivity than glass, the thermal energy is prevented from conducted to the whole layer, and can easily be stored in the heat storage section 27 between the heat generation section 22*a* and the groove section 26. In the glass layer 21, since the thermal energy is prevented from being radiated to the whole of the layer by providing the groove section 26, the thermal energy generated by the heat generation section 22*a* can be prevented from being radiated, thus the amount of heat conducted to the ink ribbon 3 can be increased. Thus, the thermal efficiency of the thermal head 2 can be improved with the glass layer 21. Further, since in the glass layer 21, the color material can immediately be heated to the sublimation temperature with low power consumption by the thermal energy stored in the heat storage section 27 in thermal-transferring the color material to the print medium 4, the thermal efficiency of the thermal head 2 can be made preferable. Further, since in the glass layer 21, the thickness of the heat storage section 27 is made thinner to reduce heat storage capacity of the heat storage section 27 by forming the groove section 26, it becomes possible to radiate the heat in a short period of time, thus the temperature of the thermal head 2 can rapidly be lowered when the heat generation section 22*a* is not heated. According to the above, the thermal efficiency and the response of the thermal head 2 can be improved with the glass layer 21 provided with the groove section 26. Thus, high quality images and characters can be printed at high speed with low power consumption without causing a problem such as a blur in the images and characters using the thermal head 2 offering preferable response.

The heat generation resistor 22 for generating thermal energy is formed on the protruding section 25 side surface of the glass layer 21, as shown in FIG. 5A. The heat generation resistor 22 is made of a material having high resistivity and heat resistance such as Ta—N or Ta—$SiO_2$. The heat generation sections 22*a*, which are each exposed between the pair of electrodes 23*a*, 23*b* of the heat generation resistor 22 and generate heat, are disposed substantially linearly on the protruding section 25, and are each formed in a size slightly larger than a dot size to be thermal-transferred for dispersing the thermal energy and having a substantially rectangular or square shape. The heat generation resistors 22 are patterned on the glass layer 21 by a photolithography technology.

Figure 6:
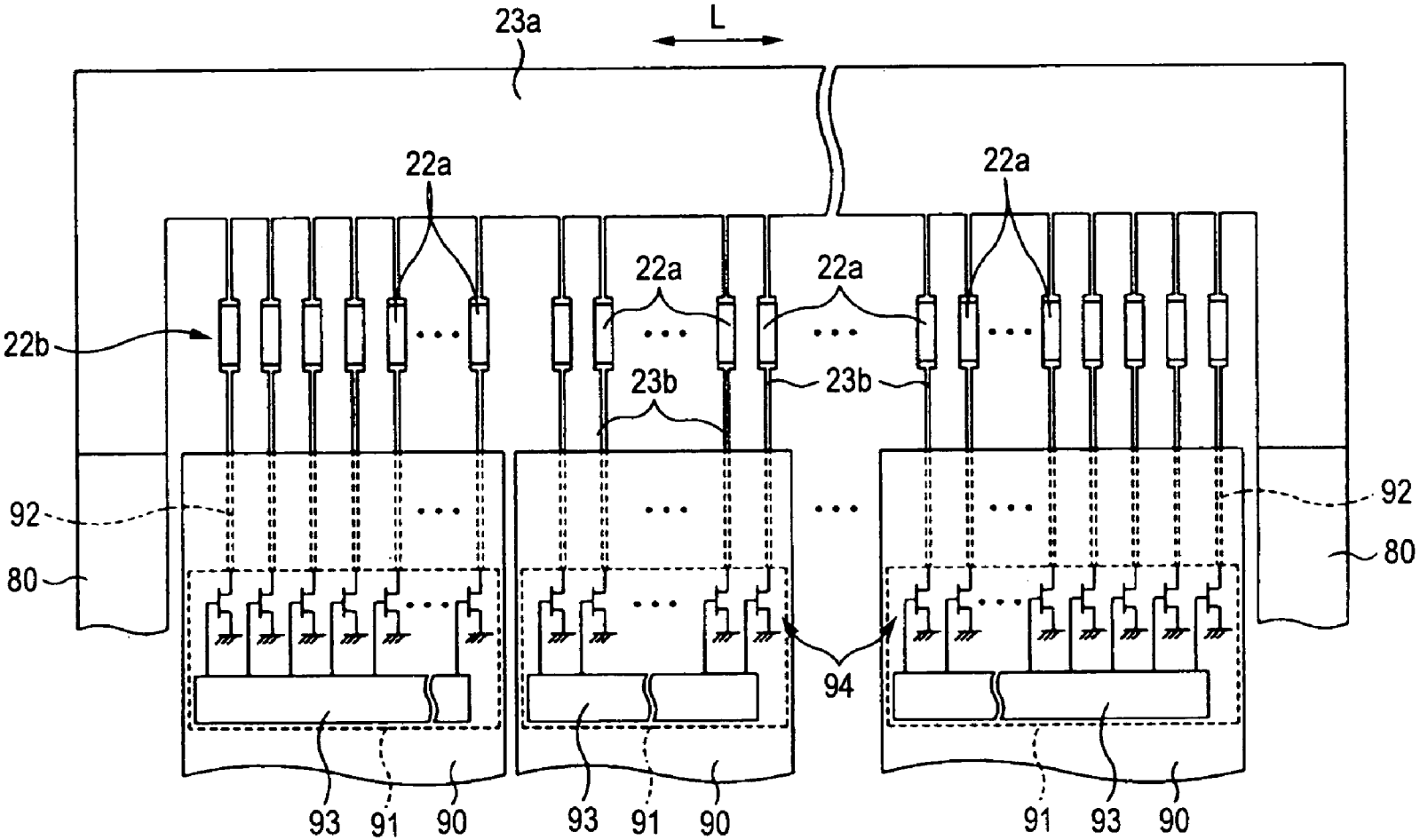
FIG. 6 is a plan view of the head section.

The pair of electrodes 23*a*, 23*b* provided to both sides of the heat generation resistor 22 supply the heat generation section 22*a* with a current from a power supply not shown in detail to make the heat generation section 22*a* generate heat. The pair of electrodes 23*a*, 23*b* are made of a material having good electrical conductivity such as aluminum, gold, or copper. As shown in FIGS. 3 and 6, the pair of electrodes 23*a*, 23*b* are composed of a common electrode 23*a* electrically connected to all of the heat generation sections 22*a* and an individual electrode 23*b* electrically connected individually to every heat generation section 22*a*, and are disposed distant from each other across the heat generation section 22*a*.

The common electrode 23*a* is disposed on one side opposite to a side where a power supply flexible board 80 described below is bonded thereon across the protruding section 25 of the glass layer 21. The common electrode 23*a* is electrically connected to all of the heat generation sections 22*a*, and the both ends thereof are led to the side where the power supply flexible board 80 is bonded thereon along the narrow sides of the glass layer 21 to be electrically connected to the power supply flexible board 80. The common electrode 23*a* is connected to a rigid board 70 electrically connected to the power supply not shown via the power supply flexible board 80, thus electrically connecting the power supply with each of the heat generation sections 22*a*.

The individual electrode 23*b* is disposed on a side where a signal flexible board 90 described below is bonded thereon across the protruding section 25 of the glass layer 21. The individual electrode 23*b* is provided to the heat generation section 22*a* one-on-one. The individual electrode 23*b* is electrically connected to the signal flexible board 90 connected to a control circuit for controlling the drive of the heat generation section 22*a* of the rigid board 70.

The common electrode 23*a* and the individual electrode 23*b* supply the heat generation section 22*a* selected by a circuit for controlling drive of the heat generation section 22*a* with a current for a predetermined period of time, thereby making the heat generation section 22*a* generate heat to raise the temperature to a point enough for sublimating the color material to be thermal-transferred to the print medium 4.

It should be noted that in the head section 20, the heat generating resistor 22 is not necessarily required to be provided to the entire surface of the glass layer 21, but it is possible that the heat generating resistor 22 is disposed on a part of the protruding section 25, and the end portions of the common electrode 23*a* and the individual electrode 23*b* are formed on the heat generating resistor 22.

As shown in FIG. 4, the resistor protective layer 24 provided as the outermost layer of the head section 20 covers the whole of the heat generation resistors 22 and the common electrodes 23*a* and the heat generation section 22*a* side end portions of the individual electrodes 23*b*, and protects the heat generation sections 22*a* and the pairs of electrodes 23*a*, 23*b* disposed around the heat generation sections 22*a* from the friction and so on caused when the thermal head 2 and the ink ribbon 3 come in contact with each other. The resistor protective layer 24 is made of an inorganic material containing metal excel in mechanical characteristic such as high-strength and abrasion resistance under high temperature and in thermal characteristic such as heat resistance, thermal shock resistance, and thermal conductivity, and is made of, for example, SIALON (a trade name) including silicon (Si), aluminum (Al), oxygen (O), and nitrogen (N).

In the head section 20 having the configuration described above, as shown in FIGS. 4, 5A, and 5B, the groove section 26 is formed on the inner surface of the glass layer 21 at a position corresponding to the line 22*b* of the heat generation section 22*a* formed substantially linearly in the length direction (the L direction in FIG. 4) of the head section 20 so as to have a width W1 (the distance between the intersections of extended lines the wall faces 30 and an extended line of the ceiling face 31*a* of the groove section 26) equal to or longer than the length L1 of the heat generation section 22*a*. In the glass layer 21, the thermal efficiency of the thermal head 2 can further be improved by forming the groove section 26 so as to have the width W1 equal to or larger than the length L1 of the heat generation section 22*a*.

In more detail, in the glass layer 21, the thickness of the both ends of the heat storage section 27 becomes thinner by forming the groove section 26 so as to have the width W1 equal to or larger than the length L1 of the heat generation section 22*a* than in the case in which the groove section 26 is formed to have the width W1 smaller than the length L1 of the heat generation section 22*a*. Thus, in the glass layer 21, it becomes difficult to radiate the thermal energy stored in the heat storage section 27 from the both ends of the heat storage section 27 to the peripheral area, namely the peripheral section 28 of the groove section 26. In particular, in the glass layer 21, by forming the groove section 26 so as to have the width W1 larger than the length of the heat generation section 22*a*, the thickness of the both ends of the heat storage section 27 becomes thinner than in the case with the width W1 equal to the length of the heat generation section 22*a*, thus the heat radiation becomes more difficult. As described above, since the heat radiation to the peripheral section 28 can be suppressed in the glass layer 21, it becomes possible to further increase the amount of heat conducted to the ink ribbon 3, and to further improve the thermal efficiency of the thermal head 2.

It should be noted that the length of the heat generation section 22*a* is, for example, 20 μm, the width of the groove section 26 is in a range of 50 μm through 700 μm, and the preferably in a range of 200 μm through 400 μm.

Figure 10:
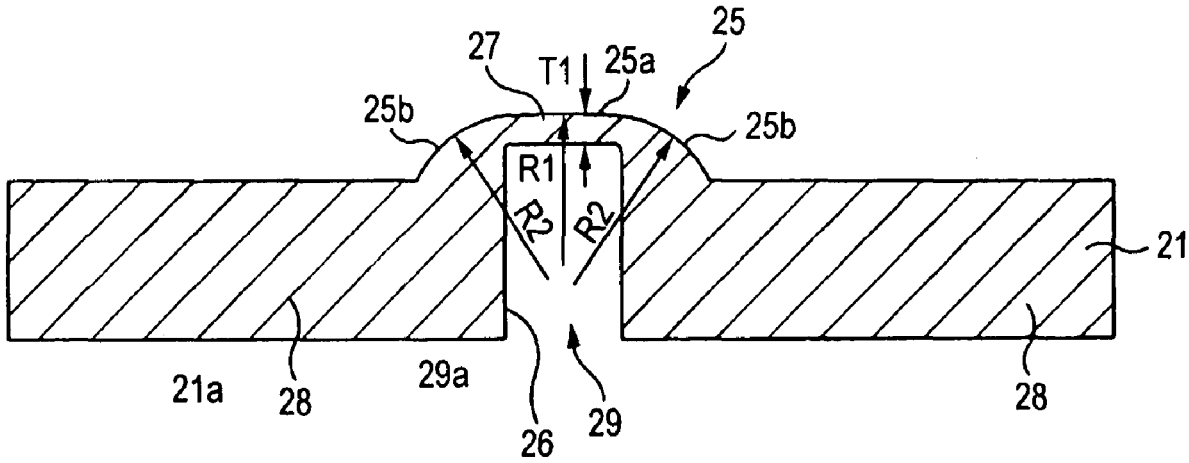
FIG. 10 is a cross-sectional view of the glass layer with a protruding section having a smaller curvature radius in both sides than in a central section.

Further, as shown in FIGS. 5A and 10, in the glass layer 21 the protruding section 25 is formed so as to have a smaller curvature radius R2 in the both side portions 25*b* than a curvature radius R1 in the central portion 25*a* (R1>R2). For example, in the glass layer 21, the curvature radius R1 of the central portion 25*a* is set to, for example, 2.5 μm, and the curvature radius R2 of the both side portions 25*b* is set to, for example, 1.0 μm. In the glass layer 21, the thickness of the glass layer 21 between the both side portions 25*b* and the groove section 26 becomes smaller, namely the thickness of the both ends of the heat storage section 27 becomes smaller by forming the protruding section 25 so as to have the smaller curvature radius R2 in the both side portions 25*b* than the curvature radius R1 in the central portion 25*a* than in the case of forming the protruding section 25 so as to have the larger curvature radius R2 in the both side portions 25*b* than the curvature radius R1 in the central portion 25*a* (R1≦R2). Thus, since the heat storage capacity of the heat storage section 27 is further reduced, and the amount of heat radiated from the both edges to the peripheral section 28 of the groove section 26 is also further reduced, the thermal efficiency thereof can further be improved. Further, since in the glass layer 21 the width of the protruding section 25 is reduced by forming the protruding section 25 so as to have the smaller curvature radius R2 in the both side portions 25*b* than the curvature radius R1 in the central portion 25*a*, the whole size of the layer can be reduced.

Further, as shown in FIG. 5A, in the glass layer 21, the groove section 26 is formed so that the wall faces 30 rise substantially vertically from the opposite side of the heat generation section 22*a*, namely the side of the base end 29. In the glass layer 21 having such a groove section 26, since the pressure caused by the platen 5 pressing the thermal head 2 and acting on the both ends 29*a* of the groove section 26 on the side of the base end 29 from the side of the protruding section 25 is not concentrated in the both ends 29*a* but is dispersed in the bottom face 21*a* of the glass layer 21, thus the physical strength against the pressure from the platen 5 is increased. Thus, in the glass layer 21 deformation or breakage of the both ends 29*a* caused by the pressure from the platen 5 can be prevented, and accordingly, deformation or breakage of the glass layer 21 can thus be prevented.

Figure 7:
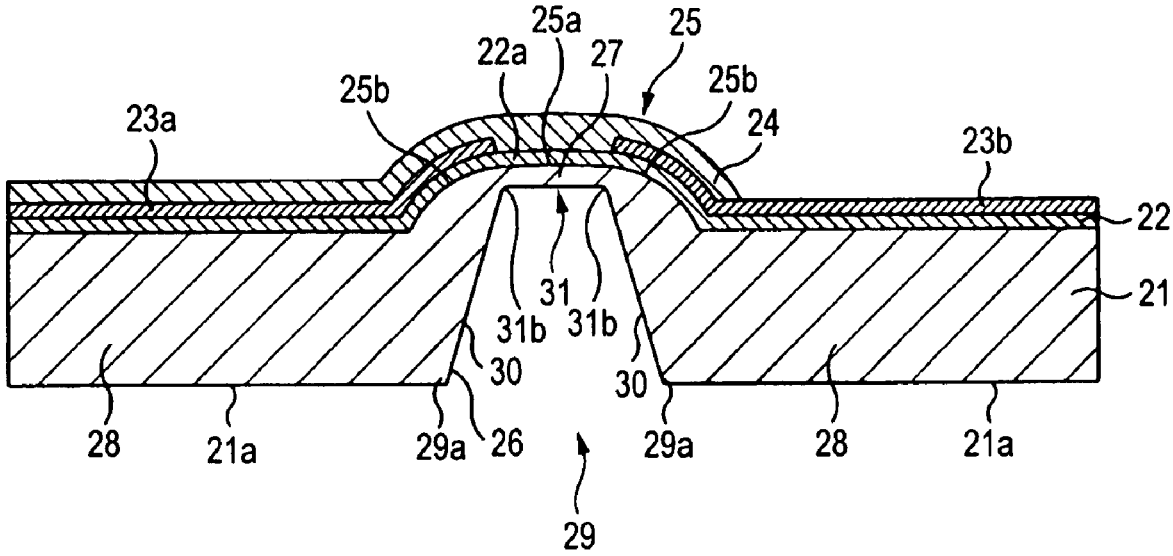
FIG. 7 is a cross-sectional view of another example of the head section.

It should be noted that the glass layer 21 can be formed, as shown in FIG. 7, so that the distance between the wall faces 30 facing in the length direction of the heat generation section 22*a* is longer in the side of the base end 29 than in the side of the leading end 31. According to such a glass layer 21, since the distance between the wall faces 30 facing in the length direction of the heat generation section 22*a* is longer in the side of the base end 29 than in the side of the leading end 31, in the case in which the groove section 26 is molded by the thermal press molding using a press die, for example, demolding can be made easier. Thus, the glass layer 21 can easily be formed by die-casting, thus improving the production efficiency.

Figure 5B:
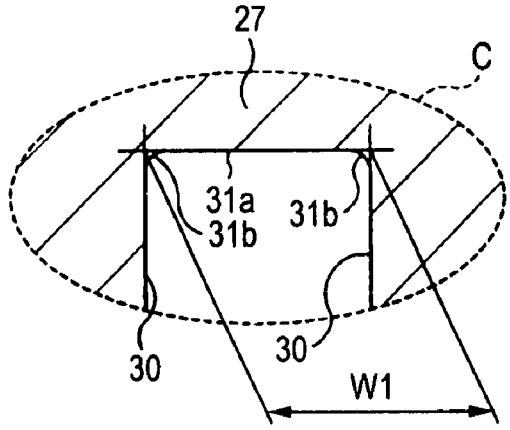

Further, as shown in FIGS. 5A and 5B, in the glass layer 21, the groove section 26 is formed so that the both end corner sections 31*b* of the ceiling face 31*a* on the side of the leading end 31 of the groove section 26 are formed as substantially circular arc shapes, and a part of the ceiling face 31*a* between the both end corner sections 31*b* is substantially flat. In the glass layer 21, by forming the both end corner sections 31*b* on the side of the leading end 31 of the groove section 26 as the substantially circular arc shapes, the pressure applied to the both end corner sections 31*b* from the protruding section 25 caused by the platen pressing the thermal head 2 is dispersed, thus the physical strength against the pressure from the platen 5 increases. Thus, in the glass layer 21, deformation and breakage of the both end corner sections 31*b* on the side of the leading end 31 of the groove section 26 caused by the pressure from the platen 5 can be prevented.

Figure 8A:
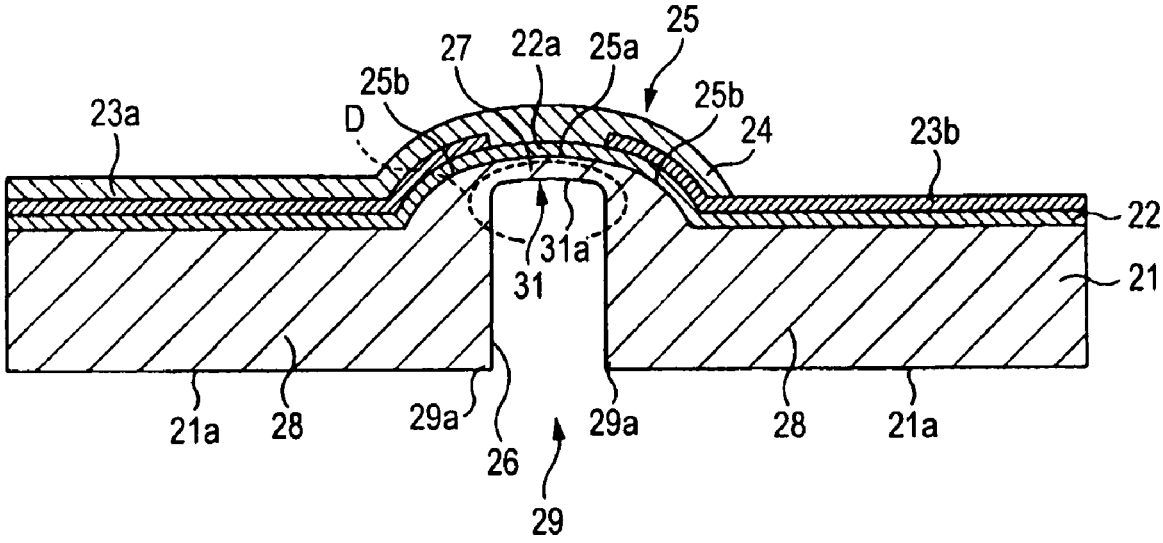
Figure 8B:
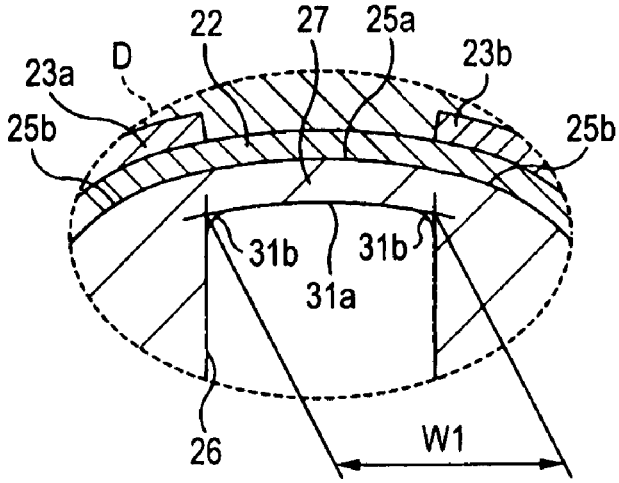
Figure 9:
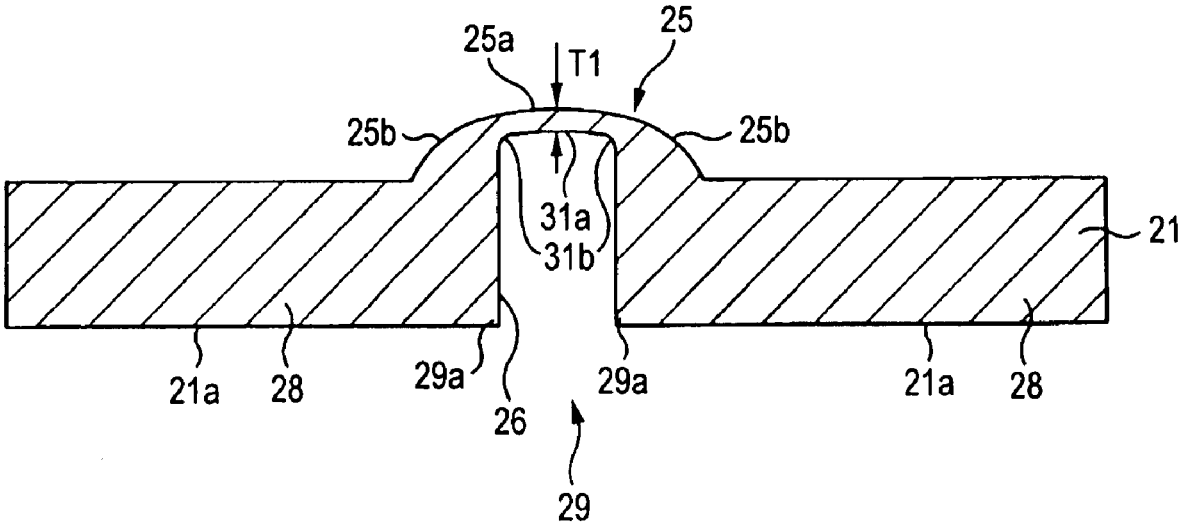
FIG. 9 is a cross-sectional view showing only the glass layer of the head section shown in FIGS. 8A and 8B.

It should be noted that as shown in FIGS. 8A, 8B, and 9, in the glass layer 21 of the head section 20, the ceiling face 31*a* of the groove section 26 can be formed to have a substantially circular arc shape along the surface of central section 25*a* of the protruding section 25 so that the thickness between the ceiling face 31*a* of the leading end 31 of the groove section 26 and the surface of the central section 25*a* of the protruding section 25, namely the thickness T1 of the protruding section 25 becomes substantially constant, namely substantially even. As shown in FIG. 9, in the glass layer 21, the ceiling face 31*a* of the groove section 26 and the central section 25*a* are formed concentrically, thus the thickness T1 of the protruding section 25 can be made substantially even. It should be noted that the thickness T1 of the protruding section 25 is in a range of 10 μm through 100 μm, preferably in a range of 20 μm through 40 μm, and particularly preferably, for example, 27.5 μm. In the glass layer 21, the stress caused by the pressure from the platen 5 is prevented from being concentrated to the both end corner sections 31*b* of the groove section 26 by making the thickness T1 of the protruding section 25 substantially even to prevent the thickness T1 of the protruding section 25 from being unevenly distributed. Thus, in the glass layer 21, high physical strength can be obtained even with the very small thickness T1 of the protruding section 25. Further, in the glass layer 21, by making the thickness T1 of the protruding section 25 substantially even, the thickness of the heat storage section 27 becomes substantially even, thus the thermal balance of the heat storage section 27 becomes preferable because there is no uneven distribution in the thickness of the heat storage section 27, thereby making the thermal efficiency and response of the thermal head 2 preferable.

According to the thermal head 2 having such a head section 20, it becomes difficult for the thermal energy generated by the heat generation section 22*a* to be radiated to the glass layer 21 by forming the groove section 26 to the glass layer 21, and the heat generation section 22*a* can be heated to be the sublimation temperature of the color material with low power consumption using the heat stored in the heat storage section 27, thus the thermal efficiency can be improved. Further, in the thermal head 2, since the thickness of the heat storage section 27 becomes smaller to reduce the heat storage capacity by providing the groove section 26 to the glass layer 21, heat radiation becomes easier, thus improving the response. Therefore, in the thermal head 2, the thermal efficiency and the response can be improved by forming the groove section 26 to the glass layer 21.

Further, in the thermal head 2, by making the width W1 of the groove section 26 of the glass layer 21 equal to or larger than the length L1 of the heat generation section 22*a*, the thickness of the both ends of the heat storage section 27 becomes smaller to make it difficult to radiate heat from the heat storage section 27, thus the radiation of the thermal energy generated by the heat generation section 22*a* is suppressed to further improve the thermal efficiency.

Further, talking of the thermal efficiency, in the thermal head 2 the width of the both sides of the heat storage section 27 is narrowed by making the curvature radius R2 of the both sides smaller than the curvature radius R1 of the central portion 25*a* of the protruding section 25 of the glass layer 21, thus the heat radiation from the heat storage section 27 becomes further difficult to further suppress the radiation of the thermal energy generated by the heat generation section 22*a*, and the thermal efficiency can further be improved.

Still further, in the thermal head 2, by making the groove section 26 of the glass layer 21 rise substantially vertically and forming the both end corner sections 31*b* on the side of the leading end 31 to have circular arc shapes as shown in FIGS. 5A and 5B, or by forming the protruding section 25 to have the substantially even thickness T1 as shown in FIG. 9, the physical strength can be increased. In the thermal head 2, by increasing the physical strength of the glass layer 21, deformation or breakage of the glass layer 21, in particular deformation or breakage of the protruding section 25 having a small thickness can be prevented even if the pressure as strong as about 45 kg per unit area caused by the pressure from the platen 5 applied in performing printing is applied to the glass layer 21.

As described above, according to the thermal head 2, since the thermal efficiency and the response are preferable, and deformation and breakage of the glass layer 21 and the protruding section 25 caused by the pressure from the platen 5 can be prevented, high quality images or characters can be printed with low power consumption at high speed. Further, in the thermal head 2, as shown in FIG. 7, by forming the groove section 26 so that the width between the wall faces 30 thereof is longer in the side of the base end 29 than in the side of the leading end 31, in the case of molding the groove section 26 by the thermal press molding using a press die, for example, demolding can be made easier, thus improving the production efficiency.

Figures 11A, 11B:
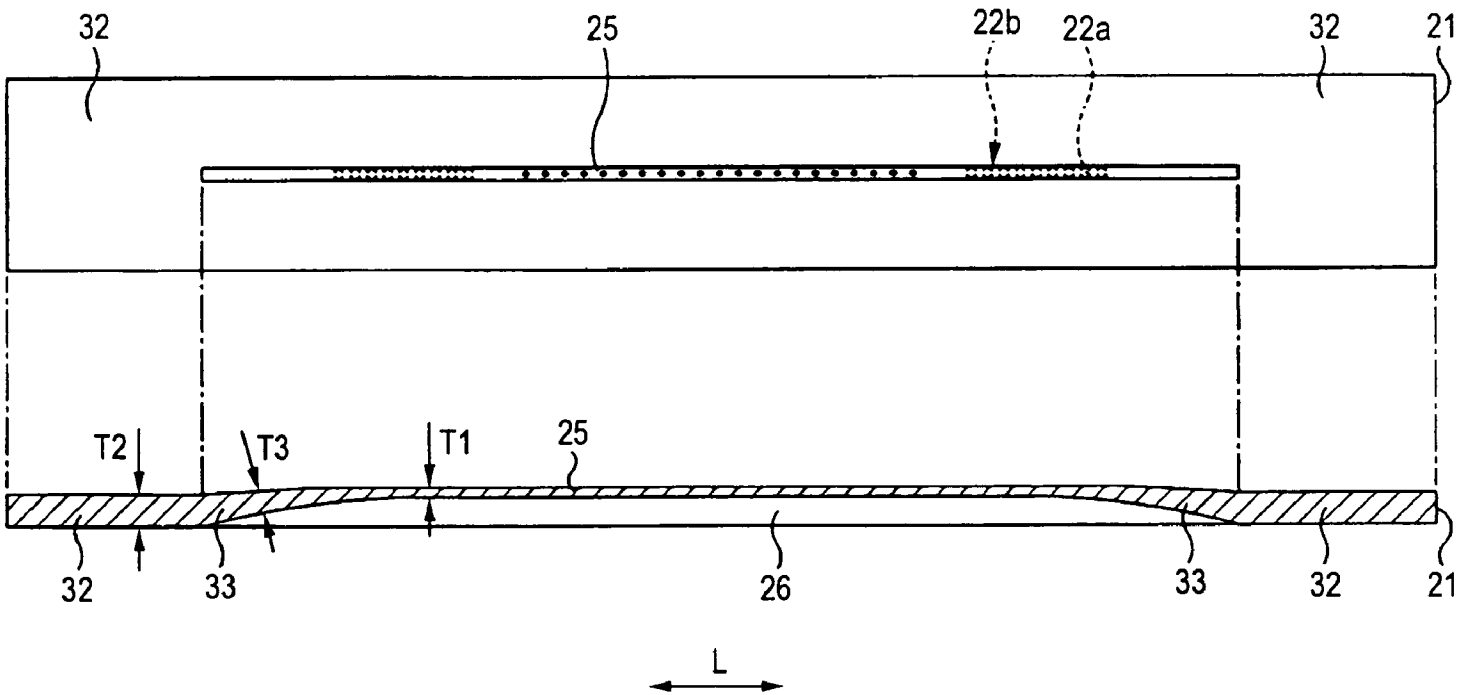
FIGS. 11A and 11B are cross-sectional views of a glass layer provided with reinforcing sections.
Figure 12:
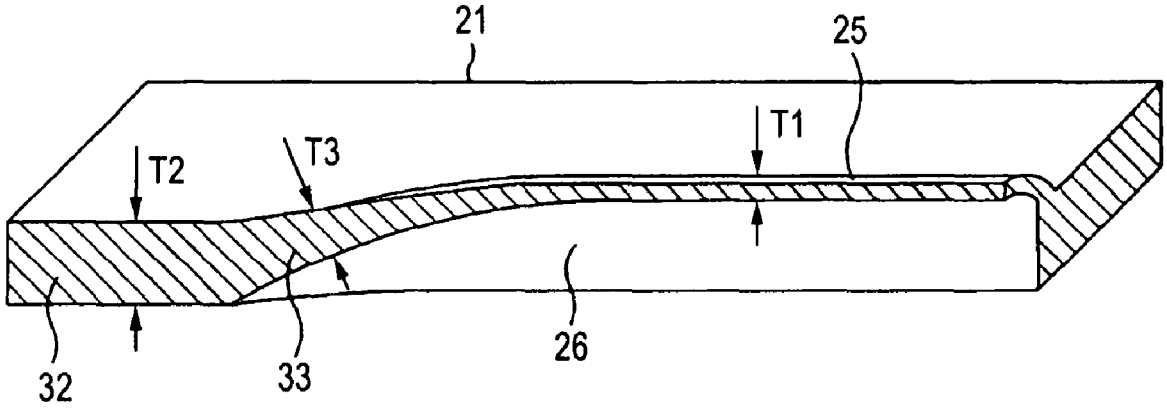
FIG. 12 is a partial cross-sectional view of the glass layer shown in FIGS. 11A and 11B.

Further, in the glass layer 21 of the head section 20, as shown in FIGS. 11A and 11B and FIG. 12, the groove section 26 is provided to face the line 22*b* of the heat generation sections 22*a* substantially linearly arranged in parallel in the length direction (the L direction in FIGS. 11A and 11B) of the head section 20, and first reinforcement sections 32 for reinforcing the strength are provided on both sides of the heat generation sections 22*a* in the arranging direction thereof. The first reinforcement sections 32 are formed by forming the glass layer 21 so as to have a larger thickness. The thickness T2 of the first reinforcement section 32 is made larger than the thickness T1 of the protruding section 25 (T2>T1). In the glass layer 21, the protruding section 25 can be reinforced by providing the first reinforcement sections 32 each having a larger thickness T2 than the thickness T1 of the protruding section 25 on the both sides of the groove section 26 in the length direction thereof. Thus, in the glass layer 21, the deformation or the breakage of the protruding section 25 caused by the pressure from the platen 5 can be prevented when the pressure from the platen 5 is applied to the glass layer 21.

Further, as shown in FIGS. 11A and 11B and FIG. 12, besides the first reinforcement sections 32, the glass layer 21 is further provided with second reinforcement sections 33 each formed inside the first reinforcement sections 32 so as to have a thickness gradually increases from the end portion of the protruding section 25 towards the first reinforcement section 32 including a thickness T3. Thus, in the glass layer 21, the protruding section 25 is further reinforced by providing the second reinforcement sections 33 in addition to the first reinforcement sections 32. Thus, in the glass layer 21, the physical strength of the protruding section 25 increases, and the deformation and breakage of the protruding section 25 caused by the pressure from the platen 5 can further be prevented.

In the thermal head 2, the physical strength of the glass layer 21 is improved by forming the first reinforcement sections 32 and the second reinforcement sections 33 on both sides of the heat generation sections 22*a* of the glass layer 21 in the arranging direction thereof, and even when the strong pressure caused by the pressure from the platen 5 applied thereto in printing operation is applied to the glass layer 21, deformation and breakage of the glass layer 21, in particular deformation and breakage of the protruding section 25 with smaller thickness can be prevented.

Figure 13:
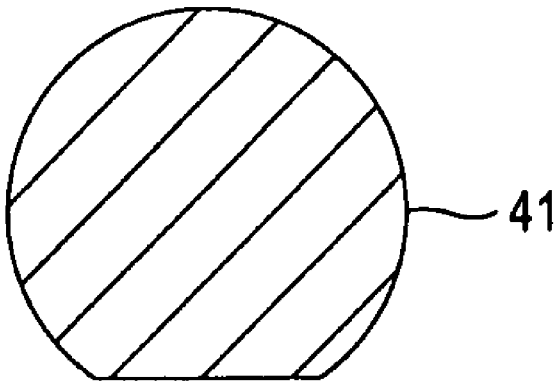
FIG. 13 is a cross-sectional view showing a glass material to be the material of the glass layer.
Figure 14:
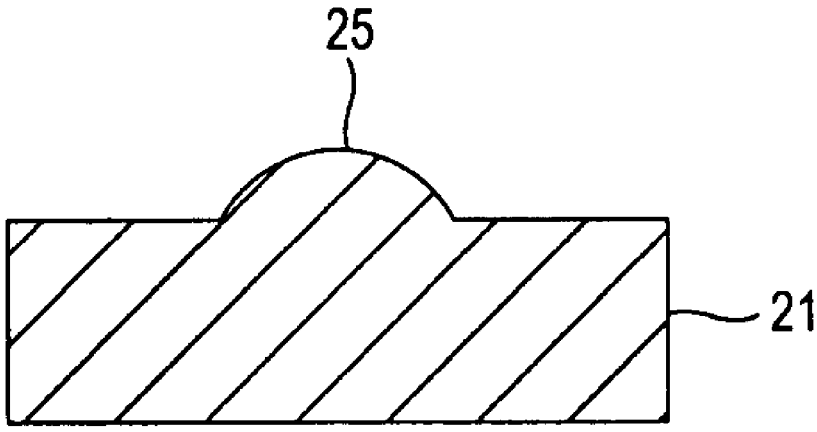
FIG. 14 is a cross-sectional view showing the glass layer.

The head section 20 having the glass layer 21 can be manufactured as described below. Firstly, as shown in FIG. 13, a glass material 41 to be used as the material of the glass layer 21 is prepared, and then as shown in FIG. 14, by performing a thermal press process on the glass material 41 to mold the glass layer 21 having the protruding section 25 on the upper surface thereof.

Subsequently, although not shown in detail, the resistor film to form the heat generation resistor 22 is formed on the surface of the glass layer 21 provided with the protruding section 25 with a material having high resistivity and thermal resistance using a thin film forming technology such as sputtering, and further, a conductive film to form the pair of electrodes 23*a*, 23*b* is then formed with a material having good electrical conductivity such as aluminum so as to have a predetermined thickness.

Figure 15:
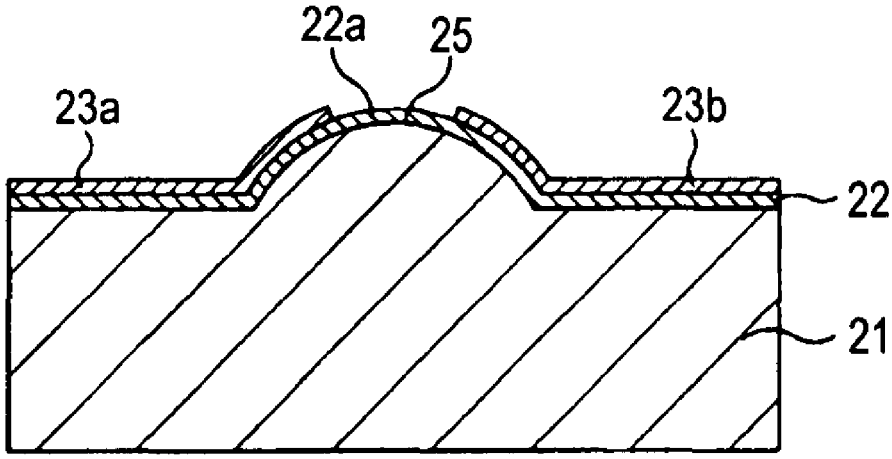
FIG. 15 is a cross-sectional view showing a condition in which a heat generating resistor and a pair of electrodes are patterned on the glass layer.

Subsequently, as shown in FIG. 15, the heat generation resistor 22 and the pair of electrodes 23*a*, 23*b* are patterned using a pattern forming technology such as a photolithography process, and the heat generation section 22*a* is formed by exposing the heat generation resistor 22 between the pair of electrodes 23*a*, 23*b*. The glass layer 21 is exposed in the portion where either the heat generation resistor 22 or the pair of electrodes 23*a*, 23*b* is not formed.

Figure 16:
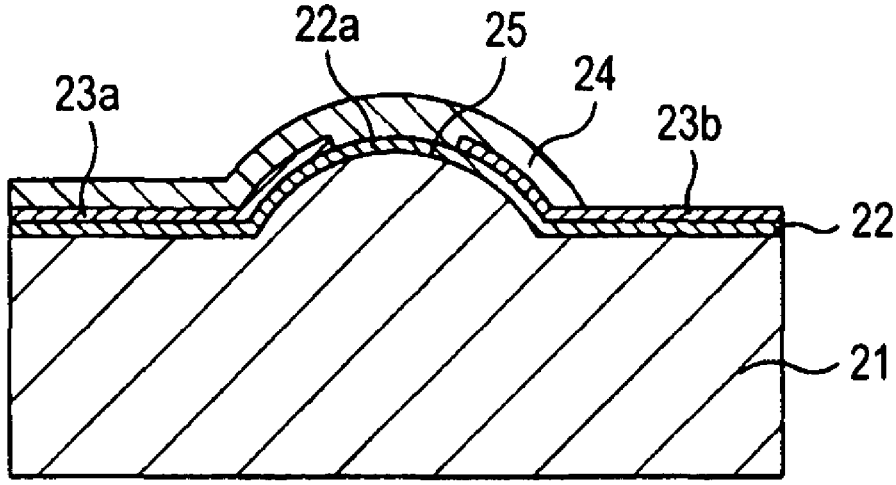
FIG. 16 is a cross-sectional view showing a condition in which a resistor protective layer is provided on the heat generating resistor and the pair of electrodes.

Subsequently, as shown in FIG. 16, the resistor protective layer 24 is formed on the heat generation resistor 22 and the pair of electrodes 23*a*, 23*b* with, for example, SIALON in a predetermined thickness using a thin film forming technology such as a sputtering process.

Figure 17:
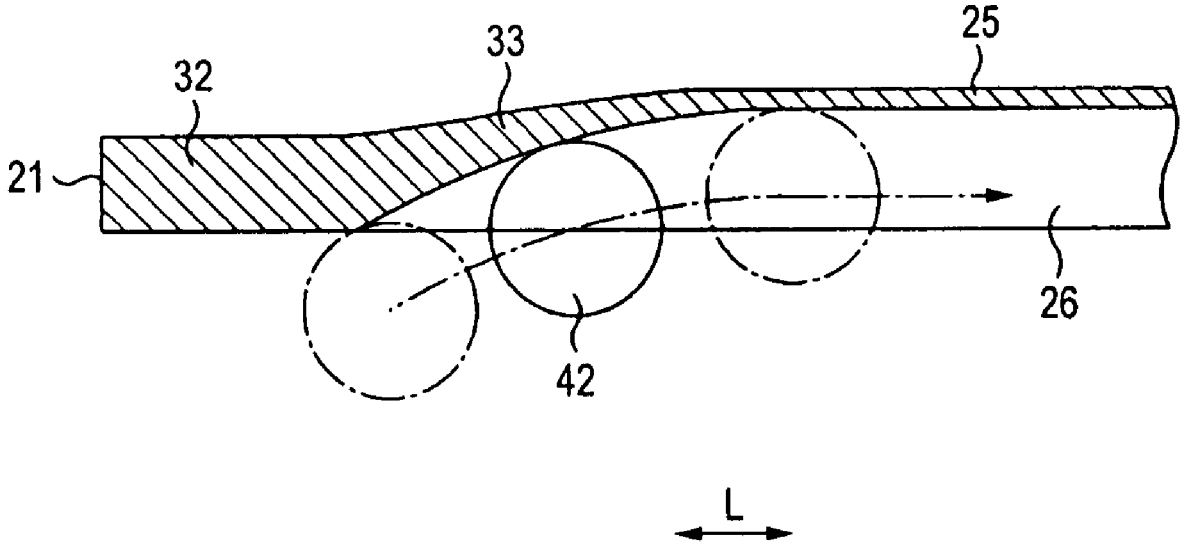
FIG. 17 is a partial cross-sectional view showing a condition in which a groove section is in a process of formation with a cutter.

Subsequently, as shown in FIG. 17, the groove section 26 having a concave shape is formed on a surface opposite the surface of the glass layer 21 on which the protruding section 25 is formed, namely the surface to be located inside the thermal head 2 by, for example, cutting with a cutter 42 so as to face the line 22*b* of the heat generation sections 22*a*, thus manufacturing the head section 20. As shown in FIG. 17, by forming the groove section 26 with the cutter 42, the first reinforcement sections 32 and the second reinforcement sections 33 can be provided to the glass layer 21 in a series of cutting processes.

It should be noted that after forming the groove section 26 by the cutting process, a hydrofluoric acid treatment can be performed on the inner surface of the groove section 26 in order for remove scratches caused on the inner surface of the groove section 26. Further, the groove section 26 can be formed by an etching process or a thermal press process besides the machining process such as a cutting process.

Further, in the case of forming the groove section 26 as shown in FIG. 7, since the wall faces 30 broadens from the side of the leading end 31 towards the side of the base end 29, demolding becomes easier, and accordingly, the groove 26 can be formed by the thermal press process using a press die. Still further, in the case of forming the groove section 26 by the thermal press process, it is possible to form the protruding section 25 with an upper die and to form the groove section 26 with a lower die, thus simultaneously forming the protruding section 25 and the groove section 26.

Figure 20:
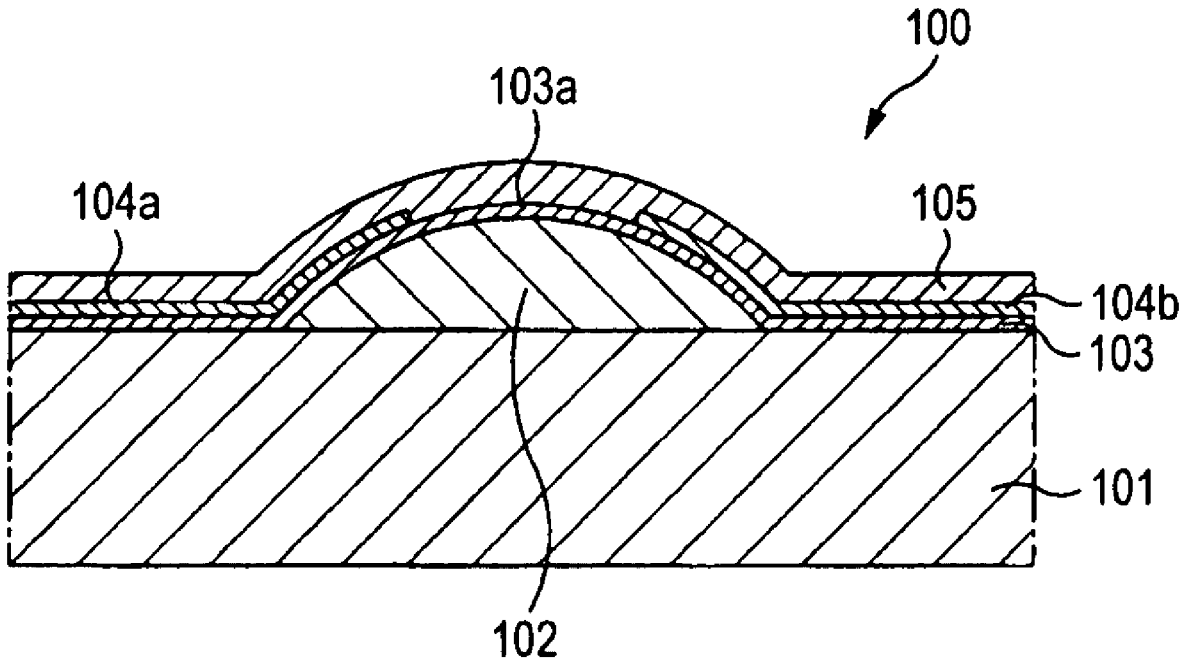
FIG. 20 is a cross-sectional view of a thermal head in the related art.
Figure 21:
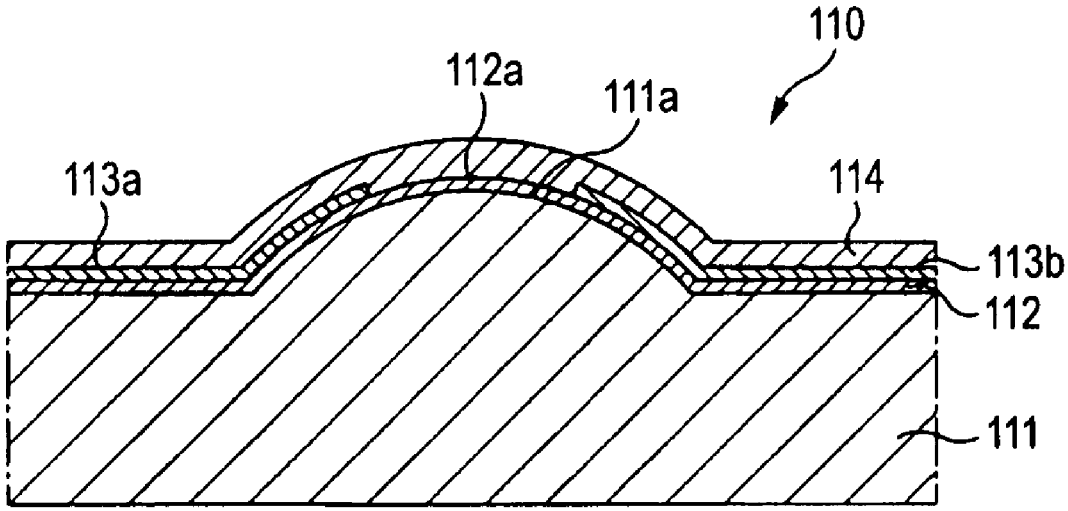
FIG. 21 is a cross-sectional view of the thermal head explained as the related art.
Figure 22:
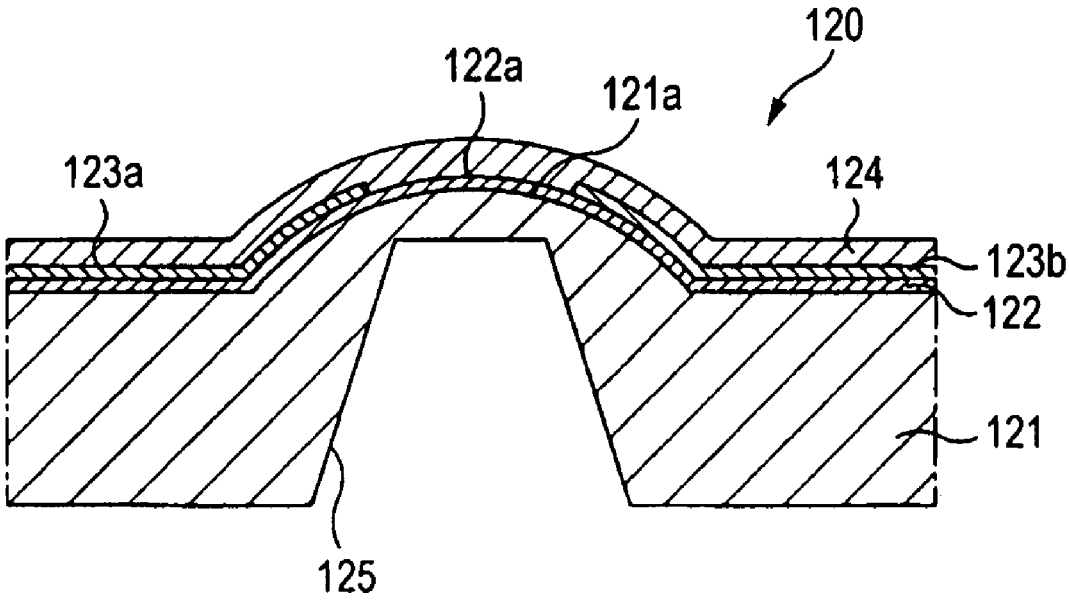
FIG. 22 is a cross-sectional view of the thermal head explained as the related art.

Since the head section 20 is formed of the glass layer 21 as a whole without using a ceramic substrate, it becomes possible to reduce the number of component by eliminating the ceramic substrate in comparison with the thermal head 100 shown in FIG. 20 using the ceramic substrate 101, thus the configuration can be made simpler. Further, according to the thermal head 2, the number of components can be reduced, and accordingly, the production efficiency can be improved.

Figure 18:
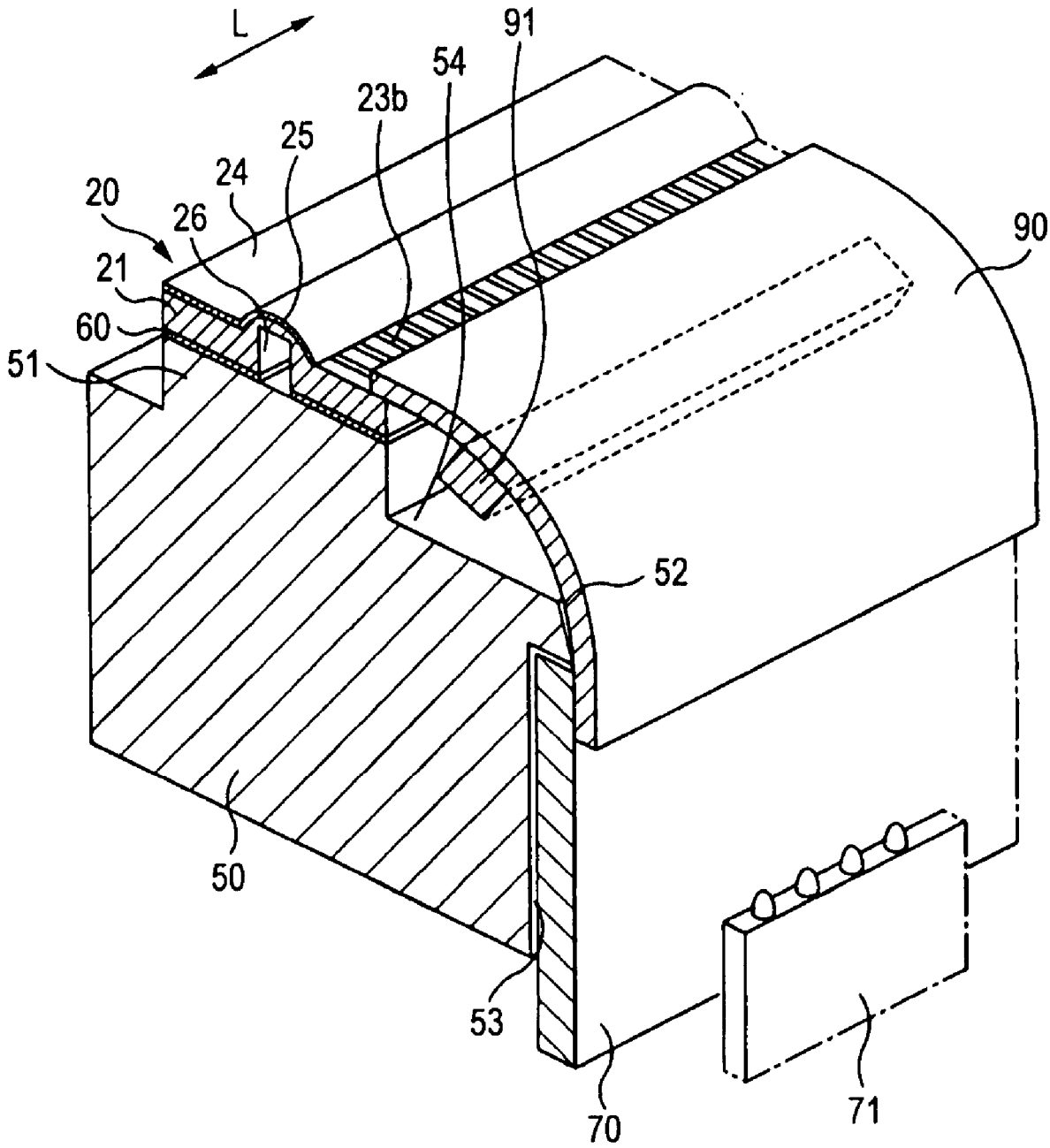
FIG. 18 is a partial perspective view of the thermal head.

As shown in FIGS. 3 and 18, in the thermal head 2 having the head section 20 described above, the head section 20 is disposed on the heat radiation member 50 via an adhesive layer 60, and the head section 20 and the rigid board 70 provided with a control circuit for the head section 20 are electrically connected to each other with the power supply flexible board 80 and the signal flexible board 90. In the thermal head 2, the rigid board 70 is disposed on the side face of the heat radiation member 50 by bending the power supply flexible board 80 and the signal flexible board 90 towards the heat radiation member 50.

The heat radiation member 50 is for efficiently radiating the thermal energy generated by the head section 20 when thermal-transferring the color material, and is made of a material having high thermal conductivity such as aluminum. As shown in FIGS. 3 and 18, the heat radiation member 50 is provided with an attachment protruding section 51 to which the head section 20 is attached formed on the upper surface in substantially the center in the width direction, and along the length direction (the L direction in FIG. 18). Further, the heat radiation member 50 is provided with an inclined section 52 for guiding the power supply flexible board 80 and the signal flexible board 90 bending along the side surface formed at the upper end of the side surface towards which the power supply flexible board 80 and the signal flexible board 90 bend, and a first notch section 53 for positioning the rigid board 70 formed at the lower end of the inclined section 52. Further, the heat radiation member 50 is provided with a second notch 54 formed so as to allow a semiconductor chip 91 described later provided to the signal flexible board 90 to be disposed on the side of the heat radiation member 50.

Figure 19:
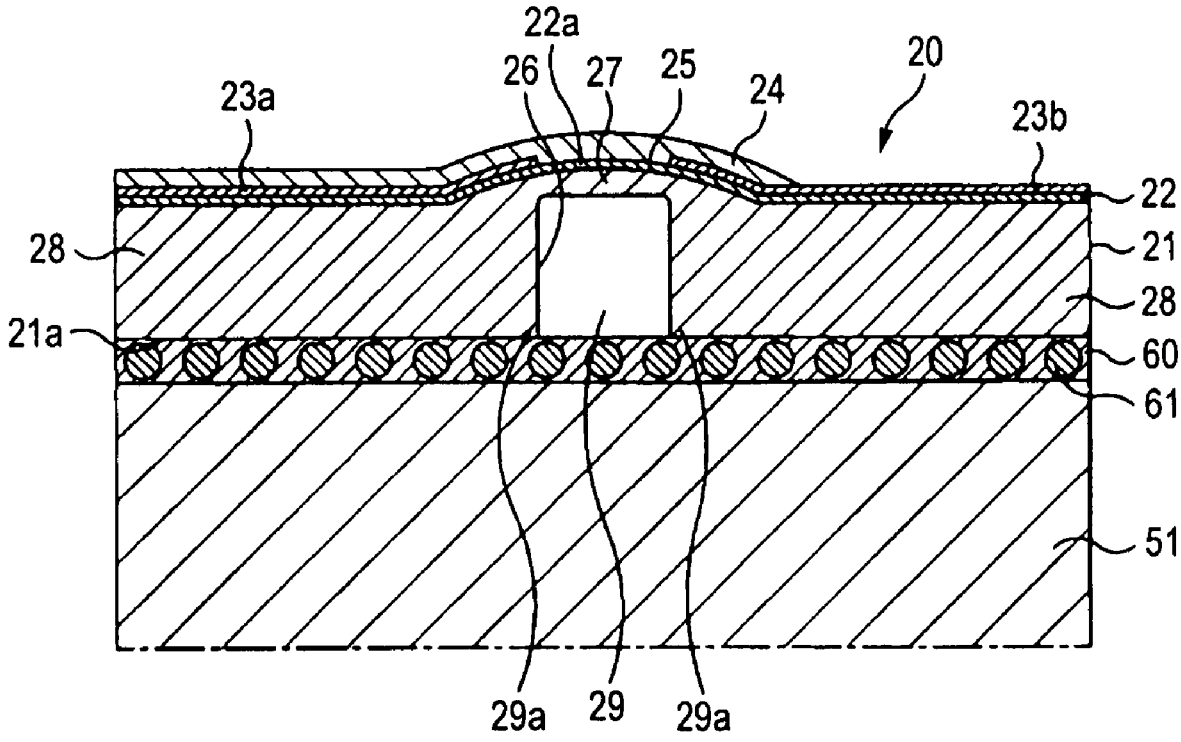
FIG. 19 is a cross-sectional view showing a condition in which the glass layer is adhered to a heat radiation member with an adhesive layer.

As shown in FIG. 19, the head section 20 is attached to the attachment protruding section 51 of the heat radiation member 50 via the adhesive layer 60. The adhesive layer 60 has thermal conductivity and is formed of an adhesive having elasticity. Since the adhesive layer 60 has thermal conductivity, it can efficiently radiate the heat generated by the head section 20 to the heat radiation member 50. Further, since the adhesive layer 60 has elasticity, even if the head section 20 and the heat radiation member 50 expand or shrink differently because of difference in the thermal expansion coefficient, it can be prevented that the head section 20 is separated from the heat radiation member 50 when the head section 20 generates heat. The thickness of the adhesive layer 60 is, for example, about 50 μm.

As shown in FIG. 19, the adhesive layer 60 is made of resin having thermal conductivity such as thermoset liquid silicone rubber containing a filler 61 having high hardness and thermal conductivity. The filler 61 contained therein is, for example, aluminum oxide of granulated or linear shapes. The adhesive layer 60 contains the filler 61 which functions as a spacer between the head section 20 and the heat radiation member 50, and accordingly, is not compressed by the head section 20 which is pressed by the platen 5, thus maintaining the constant thickness so that the ends 29*a* on the side of the base end 29 of the glass layer 21 is not deformed towards the heat radiation member 50. Thus, in the adhesive layer 60, since the thickness can be maintained constant by the filler 61, the pressure applied from the protruding section 25 to the both ends 29*a* on the side of the base end 29 of the groove section 26 in response to the head section 20 being pressed by the platen 5 is dispersed to the bottom face 21*a* of the glass layer 21, and can be received by the entire bottom face 21*a* of the glass layer 21. Further, in the adhesive layer 60, it becomes possible to let the pressure applied from the platen 5 escape in a direction parallel to the bottom face 21*a* by the filler rotating accordingly. As described above, in the thermal head 2, even if the strong pressure is applied to the glass layer 21 from the platen 5, the glass layer 21 can be prevented from being deformed towards the heat radiation member 50, thus deformation and breakage of the glass layer 21 can be prevented.

It should be noted that the filler 61 to be contained by the adhesive layer 60 can have a diameter equal to or greater than the thickness of the adhesive layer 60. Since the adhesive layer 60 contains the filler 61 having the diameter equal to or larger than the thickness of the adhesive layer 60, even if the head section 20 is pressed by the platen 5, the adhesive layer 60 is not compressed by the head section 20 because of the filler 61, thus the thickness thereof can be maintained constant, thereby further preventing deformation and breakage of the glass layer 21.

The rigid board 70 disposed on the side surface of the heat radiation member 50 shown in FIG. 3 is provided with power supply wiring not shown and for supplying current from the power supply to the head section 20 and the control circuit not shown, provided with a plurality of electronic components mounted thereon, and for controlling driving of the head section 20. As shown in FIG. 3, flexible boards 71 to form power supply lines and signal lines are electrically connected to the rigid board 70. The rigid board 70 is disposed in the first notch 53 on the side face of the heat radiation member 50 and is fixed to the heat radiation member 50 on the both sides with fixing members 72 such as screws.

As shown in FIGS. 3 and 6, the power supply flexible board 80 electrically connected to the rigid board 70 is electrically connected to wiring for power supply not shown of the rigid board 70 on one end thereof, and is electrically connected to the common electrodes 23*a* of the head section 20 on the other end thereof, thereby electrically connecting the common electrodes 23*a* of the head section 20 and the wiring of the rigid board 70 to each other to supply each of the heat generation sections 22*a* with the current. It should be noted that the power supply flexible board 80 can electrically be connected to the common electrodes 23*a* with a film made of an insulating resin material containing conductive particles such as an anisotropic conductive film (ACF) intervening between the power supply flexible board 80 and the common electrodes 23*a*. By electrically connecting the power supply flexible board 80 and the common electrode 23*a* with the AFC, the thermal energy generated by the heat generation section 22*a* can be prevented from being radiated to the side of the power supply flexible board 80 via the common electrodes 23*a*.

As shown in FIGS. 3 and 6, the signal flexible board 90 electrically connected to the control circuit of the rigid board 70 is electrically connected to the control circuit not shown of the rigid board 70 on one end thereof, and is electrically connected to the individual electrodes 23*b* of the head section 20 on the other end thereof. A plurality of signal flexible boards 90 are arranged in parallel in the length direction (the L direction in FIG. 3) of the thermal head 2.

As shown in FIGS. 6 and 18, each of the signal flexible boards 90 is provided with a semiconductor chip provided with a drive circuit for driving each of the heat generation sections 22*a* of the head section 20 disposed on one surface thereof, and is provided with connection terminals 92 for electrically connecting the semiconductor chip 91 and the each of the individual electrodes 23*b* disposed on the same surface and on the side of connection with the head section 20.

The semiconductor chip 91 provided to each of the signal flexible boards 90 is, as shown in FIG. 18, disposed inside the signal flexible board 90. As shown in FIG. 6, the semiconductor chip 91 includes a shift register 93 for converting a serial signal corresponding to the print data transmitted from the control circuit of the rigid board 70 into a parallel signal, and a switching element 94 for controlling driving of heat generation of the heat generation section 22*a*. The shift register 93 converts the serial signal corresponding to the print data into a parallel signal, and latches the converted parallel signal. The switching element 94 is provided to every individual electrode 23*b* disposed to each of the heat generation sections 22*a*. The parallel signal latched by the shift register 93 controls switching on/off of the switching element 94 to control the current supply and the supply time period to each of the heat generation sections 22*a*, thus driving and controlling the heat generation of the heat generation sections 22*a*.

As shown in FIG. 6, the connection terminals 92 are provided corresponding to each of the individual electrodes 23*b* provided one-on-one to the heat generation sections 22*a*, and electrically connecting the individual electrodes 23*b* and the semiconductor chips 91 to each other. As shown in FIG. 4, the connection terminals 92 and the individual electrodes 23*b* are electrically connected via a film 95 made of insulation resin material containing conductive particles such as an anisotropic conductive film (ACF) held between the glass layer 21 on the side of the individual electrode 23*b* and the signal flexible board 90. In the thermal head 2, by connecting the individual electrodes 23*b* of the head section 20 and the connection terminals 92 of the signal flexible boards 90 with the ACF made of an insulation resin material, even if the signal flexible boards 90 are connected adjacent to the heat generation sections 22*a*, the thermal energy generated by the heat generation sections 22*a* can be prevented from being radiated to the side of the signal flexible boards 90 via the individual electrodes 23*b*, thus degradation of the thermal efficiency can be suppressed. Thus, in the thermal head 2, the groove section 26 is provided to the glass layer 21 of the head section 20, and further, the individual electrodes 23*b* and the signal flexible boards 90 are connected with the ACF, thereby further suppressing the radiation of the thermal energy of the heat generation sections 22*a*, thus the thermal efficiency can further be improved. Further, in the thermal head 2, since the thermal energy of the heat generation sections 22*a* can be prevented from being radiated to the side of the signal flexible boards 90 via the individual electrodes 23*b* by connecting them with the ACF, the semiconductor chips 91 disposed on the signal flexible boards 90 can be protected from the heat.

It should be noted that the electrical connection between the connection terminals 92 and the individual electrodes 23*b* can be made by electrically connecting with a material containing resin and having low thermal conductivity such as a conductive paste instead of the film 95 such as the ACF. Further, in the thermal head 2, it can be arranged that the semiconductor chips 91 are disposed outside.

Still further, in the thermal head 2, it can also be arranged that by making insulating members intermediate between the heat radiation member 50 and the rigid board 70, the power supply flexible boards 80, or the signal flexible boards 90, electrical contact and mechanical contact between the heat radiation member 50 and the semiconductor chip 91, and the rigid board 70 and the heat radiation member 50 are prevented.

As described above, according to the thermal head 2, by disposing the semiconductor chips 91 having the shift register 93 for converting a serial signal into a parallel signal on the signal flexible boards 90 for electrically connecting the individual electrodes 23*b* of the head section 20 and the control circuit of the rigid board 70, serial transmission can be used between the rigid board 70 and the signal flexible boards 90, thus the number of electrical connection points can be reduced.

According to the thermal head 2 having the configuration described above, the rigid board 70 can freely be disposed around the head section 20 by connecting the head section 20 and the rigid board 70 with the power supply flexible boards 80 and signal flexible boards 90. As shown in FIGS. 3 and 18, in the thermal head 2, the semiconductor chips 91 are faced the second notch 54 of the heat radiation member 50, and the power supply flexible boards 80 and the signal flexible boards 90 are bent along the inclined section 52 of the heat radiation member 50 so that the semiconductor chips 91 come inside, thus the rigid board 70 is positioned in the first notch 53 of the heat radiation member 50. Thus, in the thermal head 2, miniaturization can be achieved by disposing the rigid board 70 on the side face of the heat radiation member 50, and accordingly, the whole printing device 1 can be downsized. Therefore, with the thermal head 2, downsizing required to the printing device 1, particularly to home-use printing devices can be realized.

Further, in the thermal head 2, the head section 20 can simply be provided on the heat radiation member 50 via the adhesive layer 60, the configuration can be simplified, and it can easily be manufactured, thus the production efficiency can be improved. Further, in the thermal head 2, the semiconductor chips 91 can be protected from static electricity by disposing the semiconductor chips inside.

In the thermal head 2, miniaturization is possible by disposing the semiconductor chips 91 inside, and disposing the rigid board 70 on the side face of the heat radiation member 50, and accordingly, as shown in FIGS. 1 and 2, the ribbon guide 6*a* in the entrance side of the print medium 4 can be disposed closer to the thermal head 2. Thus, the printing device 1 using the thermal head 2 can guide the ink ribbon 3 and the print medium 4 to a position immediately before entering the gap between the thermal head 2 and the platen 5, thus it is possible to make the ink ribbon 3 and the print medium 4 appropriately enter the gap between the thermal head 2 and the platen 5. Therefore, in the printing device 1, since it is possible to make the ink ribbon 3 and the print medium 4 appropriately enter the gap between the thermal head 2 and the platen 5, it becomes that the ink ribbon 3 and the print medium 4 make substantially the right angle with the thermal head 2, thus the thermal energy of the thermal head 2 is appropriately applied to the ink ribbon 3. Further, since the thermal head 2 can be made compact, freedom can be provided to the design of the running path of the ink ribbon 3 and the print medium 4 running near by the thermal head 2.

Further, since the semiconductor chips 91 are provided on the signal flexible boards 90 in the thermal head 2, the semiconductor chips 91 can be eliminated from the glass layer 21 of the head section 20, thus the glass layer 21 can be made smaller, and accordingly the cost can be reduced.

As shown in FIGS. 1 and 2, when printing images or characters, the printing device 1 using the thermal head 2 described above runs the ink ribbon 3 and the print medium 4 between the thermal head 2 and the platen 5 while pressing the ink ribbon 3 and the print medium 4 against the thermal head by the platen 5.

In this case, although force as strong as 45 kg per unit area is applied to the thermal head 2 from the platen 5, by forming the groove section 26 of the glass layer 21 so as to rise substantially vertically and forming the both end corners 31*b* on the side of the leading end 31 to have circular arc shapes as described above and shown in FIGS. 5A and 5B, by forming the protruding section 25 so as to have a substantially even thickness as shown in FIGS. 8A and 8B, by providing the first reinforcement sections 32 and the second reinforcement sections 33 on the both ends in the length direction of the head section 20 as shown in FIGS. 11A and 11B, or by adding filler to the adhesive layer 60 between the head section 20 and the heat radiation member 50 as shown in FIG. 19, the physical strength is improved, thus preventing deformation and breakage of the glass layer 21 caused by the pressure from the platen 5.

Then, the color material of the ink ribbon 3 is thermal-transferred to the print medium 4 running between the thermal head 2 and the platen 5. When performing the thermal transfer of the color material, the serial signal corresponding to the print data and transmitted to the control circuit of the rigid board 70 is converted into the parallel signal by the shift registers 93 of the semiconductor chips 91 provided to the signal flexible boards 90, the parallel signals thus converted are latched, and the on/off time period for the switching element 94 provided for every individual electrode 23*b* are controlled with the latched parallel signals. In the thermal head 2, when the switching element 94 is switched on, a current flows through the heat generation section 22*a* connected to the switching element 94 for a predetermined period of time, the heat generation section 22*a* generates heat, and the thermal energy thus generated is applied to the ink ribbon 3, thus the color material is sublimated to be thermal-transferred to the print medium 4. When the switching element 94 is switched off, the current flowing through the heat generation section 22*a* connected to the switching element stops, since the heat generation section 22*a* stops generating the heat, the thermal energy is not applied to the ink ribbon 3, and accordingly the color material is not thermal-transferred to the print medium 4. In the printing device 1, the serial signal for every one line of the print data is transmitted from the control circuit of the thermal head 2 to the semiconductor chips 91 of the signal flexible boards 90, and the yellow color material is thermal-transferred to the image forming section by repeating the operation described above. After thermal-transferring the yellow color material, the magenta and cyan color materials and the laminate film are sequentially thermal-transferred to the image forming section in the similar manner, thus a frame of image is printed.

When the color material of the ink ribbon 3 is thermal-transferred, since the groove section 26 having a width W1 equal to or larger than the length L1 of the heat generation section 22*a* is provided to the glass layer 21 of the head section 20 of the thermal head 2, it is difficult for the thermal energy generated by the heat generation section 22*a* to be radiated to the side of the glass layer 21, and it is also difficult for the thermal energy stored in the heat storage section 27 of the glass layer 21 to be radiated to the peripheral section 28 of the groove section 26, thus the amount of heat to the ink ribbon 3 increases. Further, in the thermal head 2, by forming the curvature radius R2 of the both sides 25*b* of the protruding section 25 of the glass layer 21 smaller than the curvature radius R1 of the central portion 25*a* thereof, it becomes further difficult for the thermal energy stored in the heat storage section 27 to be radiated to the peripheral section 28. Thus, in the thermal head 2, it becomes easy to raise the temperature of the heat generation section 22*a* with the thermal energy stored in the heat storage section 27 of the glass layer 21. From the fact described above, the thermal head 2 has preferable thermal efficiency. Further, in the thermal head 2, since the heat storage capacity of the glass layer 21 is reduced by providing the groove section 26 in the glass layer 21, when the heat generation section 22*a* does not generate heat, the temperature drops rapidly, thus preferable response can be obtained. Thus, since the printing device 1 can obtain preferable thermal efficiency and response, it can print high quality images and characters with reduced power consumption at high speed.

As described above, since the thermal head 2 can be made smaller, does not cause deformation or breakage of the glass layer 21 by the pressure from the platen 5, and has preferable thermal efficiency and response, it can print high quality images and characters with reduced power consumption at high speed even in the home-use printing device 1.

It should be noted that although the thermal head 2 is exemplified in the case of printing postcards with the home-use printing device 1, it is not limited to the home-use printing device 1, but can be applied to a business-use printing device, the size is not particularly limited, it can also be applied to L-size photo paper or plain paper in addition to the postcards, and it can achieve high speed printing even in these cases. It should be understood by those skilled in the art that various modifications, combinations, sub-combinations and alterations may occur depending on design requirements and other factors insofar as they are within the scope of the appended claims or the equivalents thereof.

What is claimed is:

1. A thermal head comprising:

a glass layer having a protruding section configured as a substantially circular arc shape and formed on one surface and a concave groove section formed on the other surface facing the protruding section, the concave groove section being defined by a ceiling face and a pair of wall faces disposed apart from each other and depending from the ceiling face;

a heat generation resistor provided on the protruding section; and a pair of electrodes provided to both sides of the heat generation resistor, wherein a part of the heat generation resistor exposed between the pair of electrodes is defined as a heat generation section, the protruding section has a pair of side circular arc-shaped portions and a central circular arc-shaped portion disposed between the pair of side circular arc-shaped portions, each one of the pair of side arc-shaped portions having a smaller curvature radius than a curvature radius of the central circular arc-shaped portion, a width of the ceiling face is one of equal to and larger than a length of the heat generation section, and the pair of wall faces extend either perpendicularly from the ceiling face or obtusely relative to the ceiling face.

2. The thermal head according to claim 1, wherein the concave groove section rises substantially vertically from a base end side.

3. The thermal head according to claim 1, wherein the concave groove section has a width between side faces facing in a length direction of the heat generation section, the width being larger on a base end side than on a leading end side.

4. The thermal head according to claim 1, wherein the concave groove section has both end corners of a ceiling face on a leading end side, the both end corners having substantially circular arc shapes.

5. The thermal head according to claim 1, wherein a ceiling face on a leading end side of the concave groove section is formed along a surface of the central circular arc-shaped portion of the protruding section so that a thickness is substantially constant.

6. The thermal head according to claim 1, wherein each one of the pair of wall faces is flat as viewed in cross-section.

7. The thermal head according to claim 6, wherein the ceiling face is one of flat and arcuate shaped as viewed in cross-section.

8. The thermal head according to claim 1, wherein, with the pair of wall faces extending perpendicularly from the ceiling face, the concave groove section is shaped generally as a rectangle as viewed in cross-section and, with the pair of wall faces extending obtusely relative to the ceiling face, the concave groove section is shaped as a trapezoid as viewed in cross-section.

9. A printing device comprising:

a thermal head including:

a glass layer having a protruding section configured as a substantially circular arc shape and formed on one surface and a concave groove section formed on the other surface facing the protruding section, the concave groove section being defined by a ceiling face and a pair of wall faces disposed apart from each other and depending from the ceiling face, a heat generation resistor provided on the protruding section, and a pair of electrodes provided to both sides of the heat generation resistor, wherein a part of the heat generation resistor exposed between the pair of electrodes of the thermal head is defined as a heat generation section, the protruding section of the glass layer has a pair of side circular arc-shaped portions and a central circular arc-shaped portion disposed between the pair of side circular arc-shaped portions, each one of the pair of side arc-shaped portions having a smaller curvature radius than a curvature radius of the central circular arc-shaped portion, and a width of the ceiling face is one of equal to and larger than a length of the heat generation section, and the pair of wall faces extend either perpendicularly from the ceiling face or obtusely relative to the ceiling face.

10. The printing device according to claim 9, wherein each one of the pair of wall faces is flat as viewed in cross-section.

11. The printing device according to claim 10, wherein the ceiling face is one of flat and arcuate-shaped as viewed in cross-section.

12. The printing device according to claim 9, wherein, with the pair of wall faces extending perpendicularly from the ceiling face, the concave groove section is shaped generally as a rectangle as viewed in cross-section and, with the pair of wall faces extending obtusely relative to the ceiling face, the concave groove section is shaped as a trapezoid as viewed in cross-section.

* * * * *